US006737943B2

(12) United States Patent
Takubo et al.

(10) Patent No.: US 6,737,943 B2
(45) Date of Patent: May 18, 2004

(54) DIELECTRIC DEVICE WITH PARTIALLY CLOSED HOLE

(75) Inventors: Osamu Takubo, Tokyo (JP); Kouji Tashiro, Tokyo (JP); Kenji Endou, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/195,800

(22) Filed: Jul. 16, 2002

(65) Prior Publication Data

US 2003/0020566 A1 Jan. 30, 2003

(30) Foreign Application Priority Data

Jul. 25, 2001 (JP) ..... 2001-225102

(51) Int. Cl.[7] ..... H01P 1/205; H01P 1/213

(52) U.S. Cl. ..... 333/206; 333/202; 333/26; 333/204

(58) Field of Search ..... 333/206, 202, 333/26, 134, 235, 219, 219.1; 505/210

(56) References Cited

U.S. PATENT DOCUMENTS

| | | | | |
|---|---|---|---|---|
| 4,636,757 A | * | 1/1987 | Harrison et al. | 333/26 |
| 5,345,202 A | * | 9/1994 | Kobayashi et al. | 333/206 |
| 5,422,612 A | * | 6/1995 | Kobayashi et al. | 333/206 |
| 5,489,882 A | | 2/1996 | Ueno | |
| 5,512,866 A | | 4/1996 | Vangala et al. | |
| 5,760,666 A | * | 6/1998 | Tada et al. | 333/206 |
| 5,864,265 A | * | 1/1999 | Ballance et al. | 333/206 |
| 5,912,603 A | * | 6/1999 | Tada et al. | 333/206 |
| 6,060,965 A | | 5/2000 | Sung et al. | |
| 6,235,341 B1 | * | 5/2001 | Hino | 333/206 |
| 6,420,942 B1 | * | 7/2002 | Hiroshima et al. | 333/26 |
| 6,472,960 B1 | * | 10/2002 | Ishikawa et al. | 333/204 |
| 6,535,077 B1 | * | 3/2003 | Hiroshima et al. | 333/206 |

FOREIGN PATENT DOCUMENTS

| | | |
|---|---|---|
| EP | 0 654 841 | 5/1995 |
| EP | 0 785 593 | 7/1997 |
| EP | 0 797 267 | 9/1997 |
| EP | 0 840 390 | 5/1998 |
| JP | 62-213301 | 9/1987 |
| JP | 2-24606 | 2/1990 |
| JP | 04-051602 | 2/1992 |
| JP | 07-249910 | 9/1995 |
| JP | 09-046108 | 2/1997 |

* cited by examiner

*Primary Examiner*—Michael Tokar
*Assistant Examiner*—Lam T. Mai
(74) *Attorney, Agent, or Firm*—Oblon, Spivak, McClelland, Maier & Neustadt, P.C.

(57) ABSTRACT

A dielectric device includes a dielectric substrate that includes at least one resonator unit. An external conductor film covers most of the outer surface of the dielectric substrate, except one end surface. The at least one resonator unit includes a first hole and a second hole. The first hole is provided in the dielectric substrate, extending from the end surface to an opposite surface, being open at the end surface and the opposite surface, and having a first internal conductor inside thereof. The second hole is provided in the dielectric substrate at a predetermined distance from the first hole, extends from the end surface toward the opposite surface, being open at the end surface, closed at the opposite surface, and having a second internal conductor inside thereof. The second internal conductor is connected to the first internal conductor at the end surface.

22 Claims, 39 Drawing Sheets

DIELECTRIC DEVICE WITH PARTIALLY CLOSED HOLE

BACKGROUND OF THE INVENTION

1. Field of the Invention

The present invention relates to dielectric devices of a wide range of devices such as resonators, oscillators, dielectric filters, duplexers and the like.

2. Description of the Related Art

Such dielectric devices are used in a high-frequency range such as sub-microwave band, microwave band, millimeter wave band, or sub-millimeter wave band. More specific examples of applications include satellite communication devices, mobile communication devices, wireless communication devices, high-frequency communication devices, or base stations for such communication devices.

In conventional dielectric devices of this type, for example, in a dielectric filter as a representative example thereof, a plurality of resonator units are composed using a common ceramic dielectric body, those resonator units are interstage capacitively or inductively coupled, and a prescribed frequency component is extracted. The ceramic dielectric body is used commonly in a plurality of resonator units and most of the outer surface thereof, excluding the open end surface, is coated with a conductive film.

Each of the resonator units comprises a first hole passing therethrough to an opposite surface (short circuit surface) which is opposite to the open end surface. The height of the ceramic dielectric body from the open end surface to the short circuit surface is typically selected as ($\lambda/4$), where $\lambda$ is a selected central frequency wavelength. Therefore, the first hole also has a length of about ($\lambda/4$).

However, heavy demands are placed upon the decrease in thickness, size, and weight of satellite communication devices, mobile communication devices, wireless communication devices, and high-frequency communication devices using such dielectric devices, and this demand cannot be met by the conventional technology setting ($\lambda/4$) as a standard for the height of the ceramic dielectric body from the open end surface to the short circuit surface.

Japanese Patent Publication No. 32321/1992 is known as a reference relating to prior art aimed at miniaturization of dielectric filters. The dielectric filter described in this publicly known reference can be conceptually considered as a dielectric filter obtained by cutting a ceramic dielectric body having a height of about ($\lambda/4$) in a position of ($\lambda/8$), which is half of ($\lambda/4$), arranging the obtained two halves in a row so that the cut surfaces thereof tie at the same side, and then connecting the through conductors divided in two on the cut surfaces.

However, a problem associated with such conventional technology is that the through conductors determining the resonant wavelength matched the height of the ceramic dielectric body and the dimensions thereof were fixed which made it difficult to adjust the resonant frequency.

Furthermore, the open end surface and short circuit surface turn up in a relationship such that each of them takes a half of surface area on the surface opposite to the cut surface. As a result, the external connection structure of input and output terminals was difficult to conform to actual demands.

Thus, in the dielectric filters of this type, because of the demand placed upon miniaturization and decrease in thickness, it was necessary to employ an input and output terminal structure allowing for surface mounting on a circuit substrate.

However, since in the above-described conventional technology, the open end surface and short circuit surface turn up in a relationship such that each of them takes a half of the surface area on the surface opposite to the cut surface, a structure has to be employed in which the surface where the open end surface and short circuit surface are present is directed upward and a lead wire is connected to the through conductor appearing on the open end surface, which makes it difficult to employ a surface mounted structure.

SUMMARY OF THE INVENTION

An object of the present invention is to provide a dielectric device permitting miniaturization and decrease in thickness.

Another object of the present invention is to provide a dielectric device allowing for resonant frequency adjustment.

Still another object of the present invention is to provide a dielectric device suitable for surface mounting.

In order to attain the above-described objects, the dielectric device in accordance with the present invention comprises a dielectric substrate and at least one resonator unit. The dielectric substrate comprises an outer surface covered with an external conductor film, excluding at least one end surface.

The resonator unit comprises a first hole and a second hole. The first hole is provided in the dielectric substrate, directed from the end surface to the surface opposite thereto, and open at the end surface and opposite surface. Thus, the first hole is a through hole. A first internal conductor is provided inside the first hole.

The second hole is provided in the dielectric substrate so that it is spaced apart from the first hole, directed from the end surface toward the surface opposite thereto, open at said end surface, and closed at a bottom portion thereof. Thus, the second hole is a blind hole. A second internal conductor is provided inside the second hole. The second internal conductor is connected to the first internal conductor at the end surface.

As described above, in the dielectric device in accordance with the present invention, the resonator unit comprises the first hole and the second hole, the first hole comprises the first internal conductor, is directed from the end surface of dielectric substrate toward the surface opposite thereto, and is open at the end surface and opposite surface. Furthermore, the second hole is spaced apart from the first hole and is directed from the end surface toward the surface opposite thereto. The second hole is provided with the second internal conductor and the second internal conductor is connected to the first internal conductor at the end surface.

Therefore, in the dielectric device in accordance with the present invention, the resonator length defining the resonant wavelength is a sum (H1+H2+D1) of the length H1 of the through conductor corresponding to the height from the end surface of the dielectric substrate to the surface opposite thereto, the depth (height) H2 of the second hole directed from the end surface toward the surface opposite thereto, and the distance D1 from the second hole to the first hole. This means that when a prescribed resonant wavelength is obtained, the height from the end surface of the dielectric substrate to the surface opposite thereto can be decreased by the sum (H2+D1) of the depth of the second hole directed from the end surface toward the surface opposite thereto and the distance D1 from the second hole to the first hole, and the dimensions and thickness of the dielectric substrate can be decreased.

More specifically, when the resonant wavelength is (λ/4), if the sum (H2+D1)=(λ/8), the height H1 from the end surface of the dielectric substrate to the surface opposite thereto also becomes (λ/8) and this height can be reduced from the usually required (λ/4) to (λ/8).

Moreover, the second hole is closed rather than open at the opposite surface, and a dielectric material having a thickness equal to a difference (H1−H2) between the height H1 of the dielectric substrate and the depth H2 of the second hole is present between the second hole and the opposite surface. Therefore, the depth H2 of the second hole can be adjusted and thus the resonant frequency can be adjusted by controlling the thickness of the dielectric material.

Furthermore, since the second hole is disposed at a distance D1 from the first hole, the resonant frequency can be also adjusted by setting the distance D1.

Moreover, the second hole is directed from the end surface toward the surface opposite thereto, is open at the end surface and is closed rather than open at the surface opposite to the end surface. Therefore, a terminal for surface mounting can be provided so as to be electrically insulated from the external conductor film in an appropriate position, for example, on a side surface or the surface opposite to the end surface. With such a structure, the terminal can be mounted onto the mounting substrate. A coupling capacitance is generated between the terminal and the internal conductor of the second hole, this capacitance being defined by the thickness and dielectric constant of the dielectric material therebetween and opposing surface areas thereof. The terminal can be also provided on the side surface of the dielectric substrate to create capacitive coupling with the internal conductor of the first hole.

In case of resonant wavelength (λ/4), the surface opposite to the end surface serves as a surface (short circuit surface) covered with an external conductor film, but in case of resonant wavelength (λ/2), the opposite surface serves as the end surface not covered with an external conductor film.

The dielectric device in accordance with the present invention covers a wide range of devices including resonators, oscillators, dielectric filters, duplexers (also referred to as antenna duplexers). When it is used as a resonator or oscillator, among those applications, one resonator unit may be sufficient. In dielectric filter or duplexer applications, there are a plurality of resonator units.

When the device in accordance with the present invention is used as a dielectric filter, a first terminal and a second terminal are provided and they are employed as input and output terminals. The first terminal is provided in a position opposite, via the dielectric substrate, to the second hole provided in one of the resonator units. The second terminal is provided in a position opposite, via the dielectric substrate, to the second hole provided in another resonator unit. Both those first and second terminals are insulated from the external conductor.

With such configuration, the first and second terminals can be surface mounted onto a mounting substrate. The first and second terminals may be provided on the opposite surface or they may be provided on the side surface of the dielectric substrate, excluding the end surface and opposite surface. Furthermore, the first and second terminals may be also provided so as to be capacitively coupled to the first internal conductor.

In case of application as a duplexer (antenna duplexer), at least three resonator units and first to third terminals are provided. The first to third terminals are installed according to respective different resonator units and are used as an antenna terminal, receive terminal, and transmit terminal.

With such configuration, the first to third terminals can be surface mounted onto a mounting substrate. The first to third terminals may be provided on the opposite surface or they may be provided on the side surface of the dielectric substrate, excluding the end surface and opposite surface. Furthermore, the resonant frequency can be adjusted by setting the depth of the second hole or the distance between the first hole and second hole.

Other objects, configurations, and advantages of the present invention will be described with greater detail hereinbelow with reference to the drawings attached. However, the technological scope of the present invention is obviously not limited to the embodiments thereof illustrated in the drawings.

DESCRIPTION OF THE PREFERRED EMBODIMENTS

Figure 1:
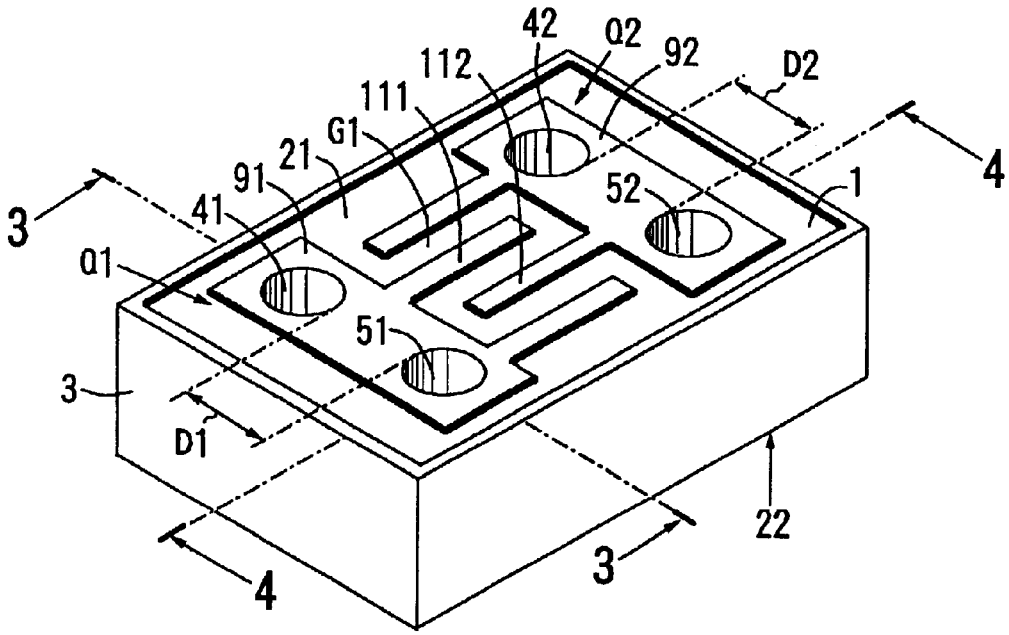
FIG. 1 is a perspective view of the dielectric filter in accordance with the present invention.

Referring to FIGS. 1 to 4, an example of a dielectric device comprising two resonator units Q1, Q2 is explained. The resonator units Q1, Q2 include a common dielectric substrate 1 and are integrated via common dielectric substrate 1. Common dielectric substrate 1 is formed to have a substantially hexagonal shape by using a conventional dielectric material. External conductor film 3 covers most of the outer surface of dielectric substrate 1, except one surface serving as end surface 21. External conductive film 3 typically contains copper, silver or the like as the main component and is formed by baking, plating or the like.

Resonator unit Q1 comprises a first hole 41 and a second hole 51. First hole 41 is a through hole which is directed from end surface 21 to surface 22 opposite thereto and is open at end surface 21 and opposite surface 22. A first internal conductor 61 connected to external conductive film 3 located on opposite surface 22 is provided inside first hole 41. First internal conductor 61 is composed of a conductive film formed on the inner surface of first hole 41. First internal conductor 61 is formed from the same material and by the same means as external conductive film 3. Alternatively, first hole 41 may be filled partially or completely with first internal conductor 61.

Second hole 51 is arranged almost parallel to first hole 41 at a distance D1 from first hole 41. Second hole 51 is a blind hole; it is directed from end surface 21 toward surface 22 opposite thereto, but is open only at end surface 21. Second hole 51 is closed at the side of opposite surface 22 which faces end surface 21. A dielectric portion 71 with a thickness T1 is present between the bottom surface of second hole 51 and opposite surface 22.

Second hole 51 is provided with a second internal conductor 81. Second internal conductor 81 is connected to first internal conductor 61 with a conductive film 91 on end surface 21. Second internal conductor 81 is composed of a conductive film formed on the inner surface of second hole 51. Second internal conductor 81 is formed from the same material and by the same means as first internal conductor 61. Alternatively, second hole 51 may be filled partially or completely with second internal conductor 81.

Resonator unit Q2 comprises a first hole 42 and a second hole 52. First hole 42 is a through hole which is directed from end surface 21 to surface 22 opposite thereto and is open at end surface 21 and opposite surface 22. A first internal conductor 62 connected to external conductive film 3 located on opposite surface 22 is provided inside first hole 42. First internal conductor 62 is composed of a conductive film formed on the inner surface of first hole 42.

Second hole 52 is a blind hole arranged almost parallel to first hole 42 at a distance D2 from first hole 42. Second hole 52 is directed from end surface 21 toward surface 22 opposite thereto, but is open only at end surface 21. Second hole 52 is closed at the side of opposite surface 22 which faces end surface 21. A dielectric portion 72 with a thickness T2 is present between the bottom surface of second hole 52 and opposite surface 22.

Second hole 52 is provided with a second internal conductor 82. Second internal conductor 82 is connected to first internal conductor 62 with a conductive film 92 on end surface 21. Second internal conductor 82 is composed of a conductive film formed on the inner surface of second hole 52.

Furthermore, in this embodiment, resonator unit Q1 has a coupling electrode 111 extending from conductive film 91 toward resonator unit Q2, and resonator unit Q2 has a coupling electrode 112 extending from conductive film 92 toward resonator unit Q1. An insulating gap G1 is provided between coupling electrode 111, conductive film 91 and coupling electrode 112, conductive film 92. Therefore, in the present embodiment, resonator units Q1, Q2 are capacitively coupled via insulating gap G1 between coupling electrode 111, conductive film 91 and coupling electrode 112, conductive film 92.

Figure 2:
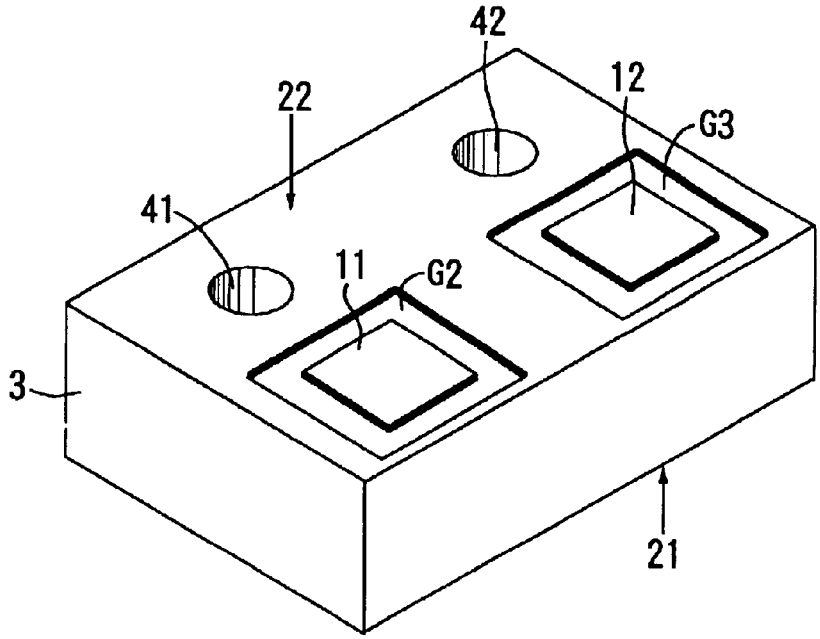
FIG. 2 is a perspective view of the dielectric fitter shown in FIG. 1, as viewed from the bottom surface thereof.
Figure 3:
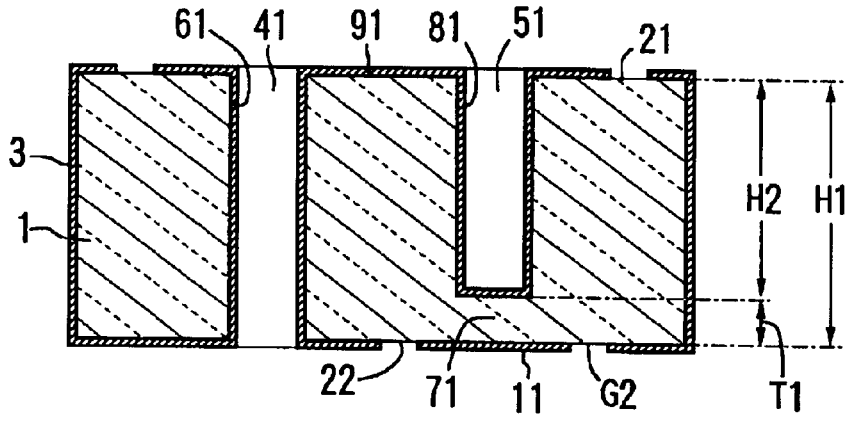
FIG. 3 is a cross-sectional view along line 3—3 in FIG. 1.
Figure 4:
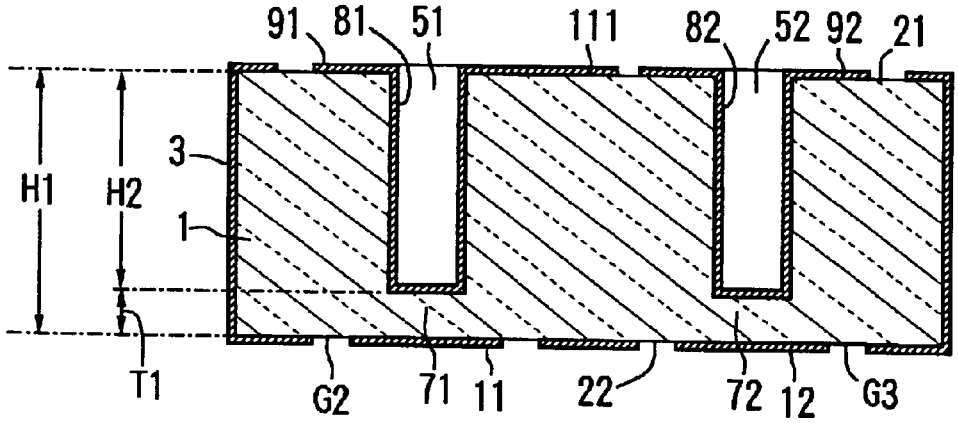
FIG. 4 is a cross-sectional view along line 4—4 in FIG. 1.

As shown in FIG. 2 and FIG. 3, a first terminal 11 and a second terminal 12 serving as input and output terminals are provided on opposite surface 22 of dielectric substrate 1. First terminal 11 is provided in a position opposite to second hole 51 via a dielectric portion 71 and is electrically insulated from external conductive film 3 by an insulating gap G2.

Second terminal 12 is provided in a position opposite to second hole 52 via a dielectric portion 72 and is electrically insulated from external conductive film 3 by an insulating gap G3. More specifically, first and second terminals 11, 12 are provided on opposite surface 22 at the side thereof opposite to end surface 21.

A coupling capacitance is generated between first and second terminals 11, 12 and internal conductors 81, 82 of second holes 51, 52, this capacitance being defined by the thickness of dielectric portions 71, 72 therebetween, their dielectric constants, and opposing surface areas thereof. It is not necessary that first and second terminals 11, 12 overlap internal conductors 81, 82 of second holes 51, 52. The terminals may also be provided in positions which partially face the conductors or do not face them at all. Furthermore, insulating gaps g2, g3 may be connected to form a single gap.

The advantages of the dielectric filter shown in FIGS. 1 to 4 will be described below with reference to resonator unit Q1. Resonator unit Q2 has the same structure as resonator unit Q1 and the explanation conducted with respect to resonator unit Q1 is directly applicable thereto.

As has already been described, in resonator unit Q1, first hole 41 is directed from end surface 21 of dielectric substrate 1 to surface 22 opposite thereto and is open at end surface 21 and opposite surface 22. First hole 41 is provided with first internal conductor 61 connected to external conductor film 3 present on opposite surface 22. Second hole 51 is located at a distance D1 from first hole 41 and is directed from end surface 21 toward surface 22 opposite thereto. Second hole 51 of resonator unit Q1 is provided with second internal conductor 81, and second internal conductor 81 is connected to first internal conductor 61 at end surface 21.

Therefore, in resonator unit Q1, the resonator length determining the resonant wavelength is a sum (H1+H2+D1) of the length H1 of through hole 41 corresponding to a height from end surface 21 of dielectric substrate 1 to surface 22 opposite thereto, the depth (height) H2 of second hole 51 directed from end surface 21 toward surface 22 opposite thereto, and the distance D1 from second hole 51 to first hole 41.

It means that in order to obtain the prescribed resonant length, the height H1 from end surface 21 of dielectric substrate 1 to surface 22 opposite thereto can be reduced by the sum (H2+D1) of the depth H2 of second hole 51 and the distance D1 from second hole 51 to first hole 41. Therefore, dielectric substrate 1 can be made thinner and smaller.

More specifically, in case of a dielectric filter with a resonant wavelength of ($\lambda/4$), if the sum (H2+D1) is considered equal to ($\lambda/8$), the height (H1) from end surface 21 of dielectric substrate 1 to surface 22 opposite thereto also becomes ($\lambda/8$) and a height thereof can be reduced by half from the usually required ($\lambda/4$) to ($\lambda/8$). The same is true for resonator unit Q2 having the same configuration as resonator unit Q1.

Moreover, second hole 51 is closed rather than open at opposite surface 22, and dielectric portion 71 with a thickness T1 corresponding to a difference (H1−H2) between the height H1 of dielectric substrate 1 and depth H2 of second hole 51 is present between second hole 51 and opposite surface 22. Therefore, the depth H2 of second hole 51 and therefore the resonant frequency can be adjusted by the thickness T1 of dielectric portion 71.

Figure 5:
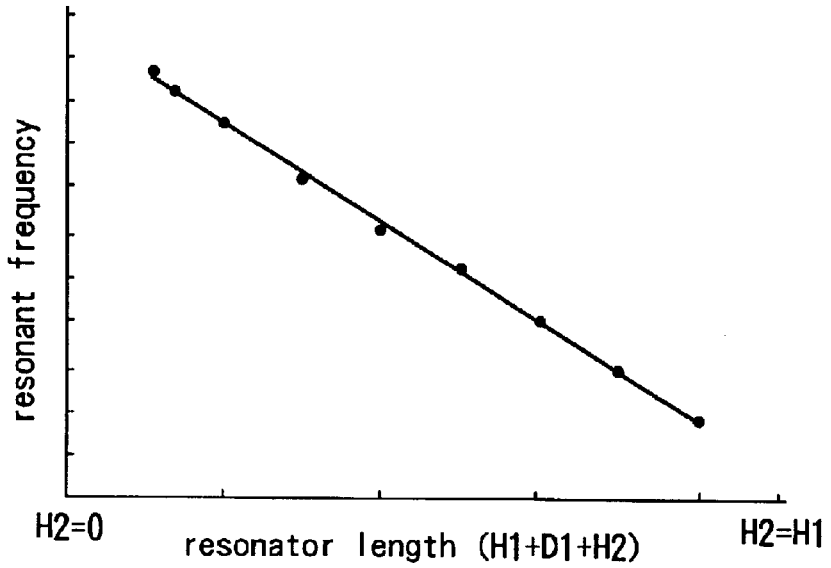
FIG. 5 illustrates the relationship between the resonant frequency and resonator length of the dielectric filter shown in FIGS. 1 to 4.

FIG. 5 illustrates the relationship between a resonant frequency and a resonator length. In this figure, the resonator length (H1+H2+D1) is plotted against the abscissa, and the resonant frequency is plotted against the ordinate. As shown in FIG. 5, when the depth H2 of second hole 51 is changed within a range from H2=0 to H2=H1, the resonant frequency changes linearly. Therefore, the resonant frequency can be adjusted by changing the depth H2 of second hole 51.

Since second hole 51 is disposed at a distance D1 from first hole 41, the resonant frequency can also be adjusted by setting the distance D1.

Moreover, in the embodiment comprising two resonator units Q1, Q2, the above-mentioned frequency adjustment can be conducted independently for each resonator unit Q1, Q2. Therefore, the adjustment of resonant frequency is facilitated.

Second hole 51 is a blind hole; it is closed at surface 22 opposite to end surface 21 and not open thereat. Therefore, first terminal 11 for surface mounting can be electrically insulated from external conductor film 3 by insulating gap G2 on opposite surface 22. With such configuration, first terminal 11 can be surface mounted on a mounting substrate.

The same is true for resonator unit Q2 having the same configuration as resonator unit Q1. Second terminal 12 can be electrically insulated from external conductor film 3 with insulating gap G3 on opposite surface 22. Therefore, second terminal 12 can be surface mounted on the mounting substrate.

Figure 6:
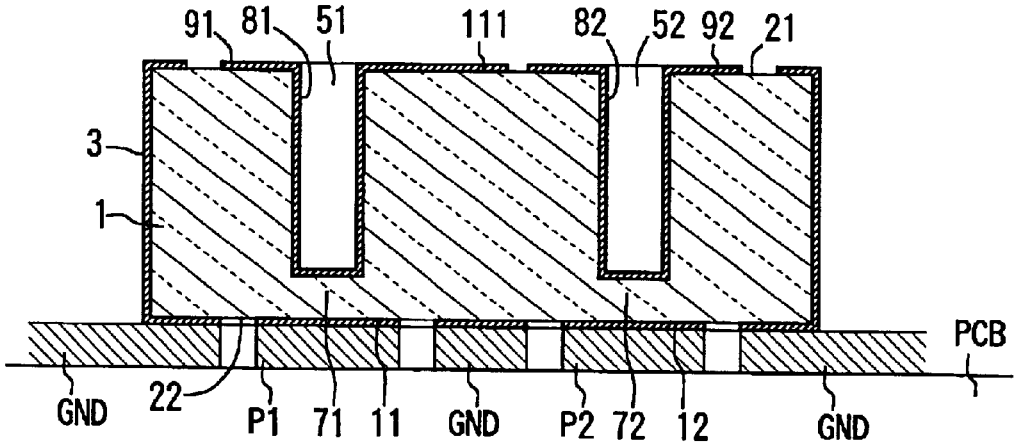
FIG. 6 is a cross-sectional view showing the state in which the dielectric filter shown in FIGS. 1 to 4 is mounted on a substrate.

FIG. 6 is a cross-sectional view illustrating the state in which the dielectric filter shown in FIGS. 1 to 4 is mounted onto a substrate. The dielectric filter is surface mounted onto print circuit board (PCB) by connecting first terminal 11 and second terminal 12 by a connecting means such as soldering to conductive patterns P1, P2 provided on PCB. External conductor film 3 is connected to a ground pattern provided on PCB.

Figure 7:
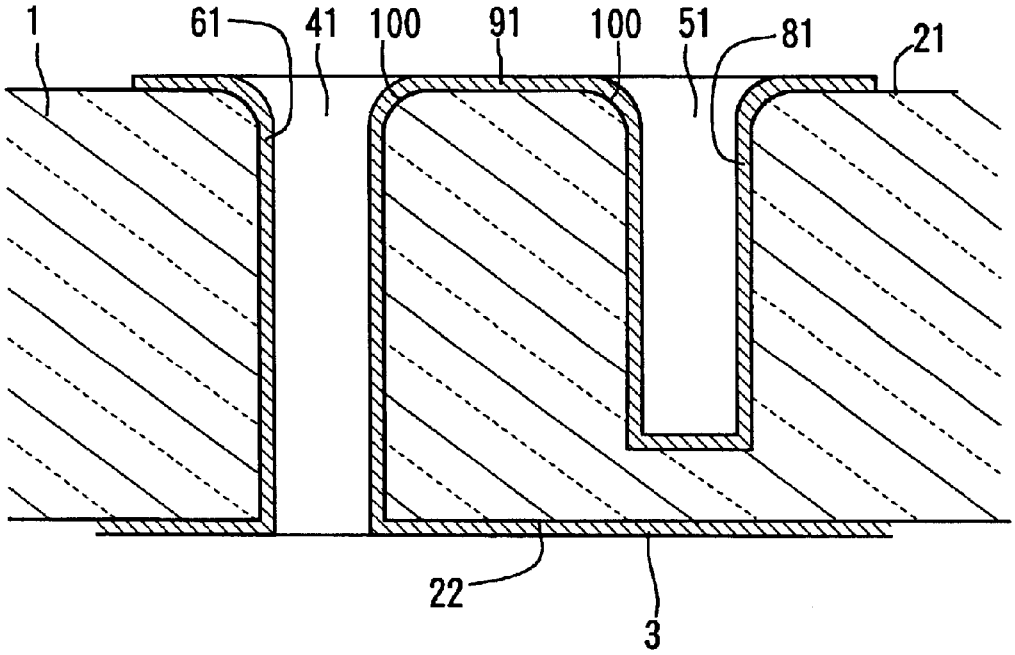
FIG. 7 is a cross-sectional view illustrating an expanded portion of the dielectric filter shown in FIGS. 1 to 4.

FIG. 7 is a cross-sectional view illustrating an expanded portion of the dielectric filter shown in FIGS. 1 to 4. This embodiment illustrates an example of modification relating to the shape of first hole 41 and second hole 51. The edge of the end of first hole 41 and second hole 51 is formed as a gradually expanding tilted portion 100. In the figure, tilted portion 100 is in the form of an arc, but it may also be in the form of a straight line, broken line, and the like.

If such tilted portion 100 is present, the reflection in the transmission line composed of first internal conductor 61, conductive film 91, and second internal conductor 81 can be reduced. It can be remarked in advance that a similar structure can be also employed in the below-described embodiments.

Various embodiments of the dielectric filter in accordance with the present invention will be successively described hereinbelow with reference to the attached FIGS. 8 to 60. In the aforesaid attached drawings, structural components identical to those shown in the above-described drawings will be assigned with the same reference symbols and the explanation thereof will be omitted.

Figure 8:
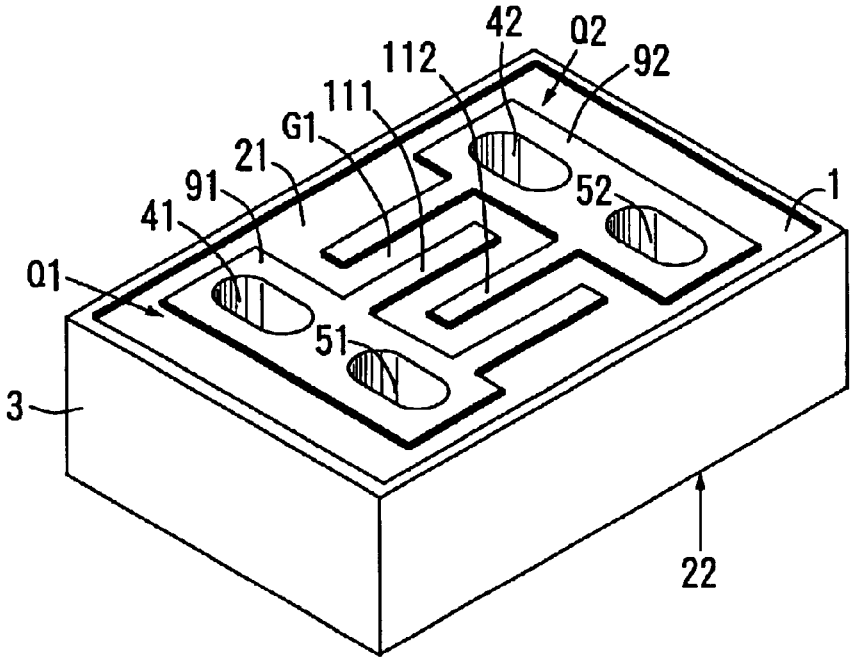
FIG. 8 is a perspective view illustrating yet another embodiment of the dielectric filter in accordance with the present invention.

FIG. 8 is a perspective view illustrating another embodiment of the dielectric filter in accordance with the present invention. In the embodiment shown in FIG. 8, first holes 41, 42 and second holes 51, 52 are elongated openings with both ends thereof in the form of circular arcs. First holes 41, 42 and second holes 51, 52 can also have openings in a variety of other shapes.

Coupling between resonator units Q1, Q2 and also coupling capacitance between second internal conductors 81, 82 of second holes 51, 52 (see FIGS. 1 to 4) and first terminal 11 and second terminal 12 can be adjusted by selecting the opening shape of first holes 41, 41 and second holes 51, 52.

Figure 9:
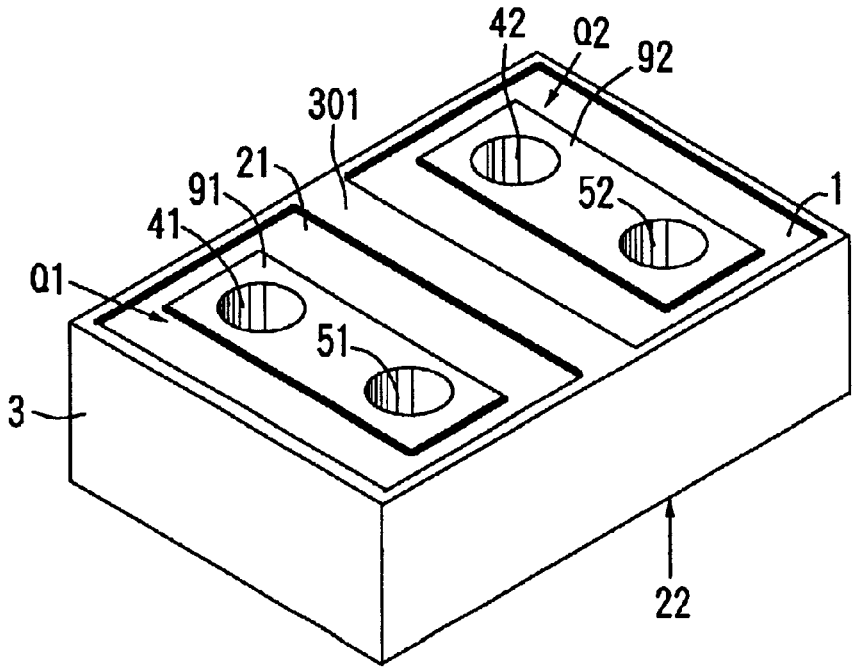
FIG. 9 is a perspective view illustrating still another embodiment of the dielectric filter in accordance with the present invention.

FIG. 9 is a perspective view illustrating another embodiment of the dielectric fitter in accordance with the present invention. A specific feature of the embodiment shown in FIG. 9 is in that a conductor film 301 is provided on end surface 21 between resonator unit Q1 and resonator unit Q2, inductively coupling resonator unit Q1 and resonator unit Q2. Conductor film 301 is connected at both ends thereof to external conductor film 3.

Figure 10:
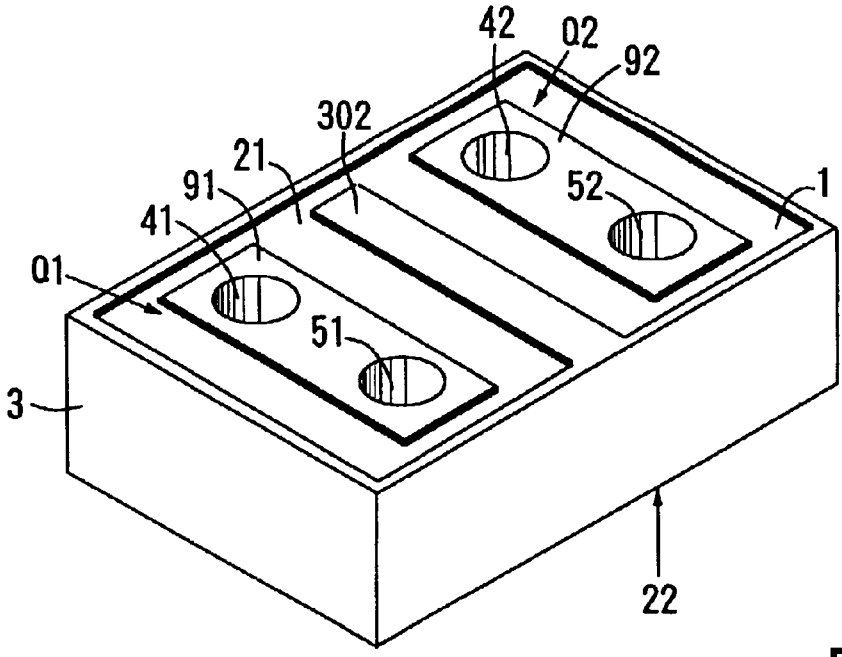
FIG. 10 is a perspective view illustrating yet another embodiment of the dielectric filter in accordance with the present invention.

FIG. 10 is a perspective view illustrating another embodiment of the dielectric filter in accordance with the present invention. A specific feature of the embodiment shown in FIG. 10 is in that a conductor film 302 is provided on end surface 21 between resonator unit Q1 and resonator unit Q2, inductively coupling resonator unit Q1 to resonator unit Q2. Conductor film 302 is connected at one end thereof to external conductor film 3.

Figure 11:
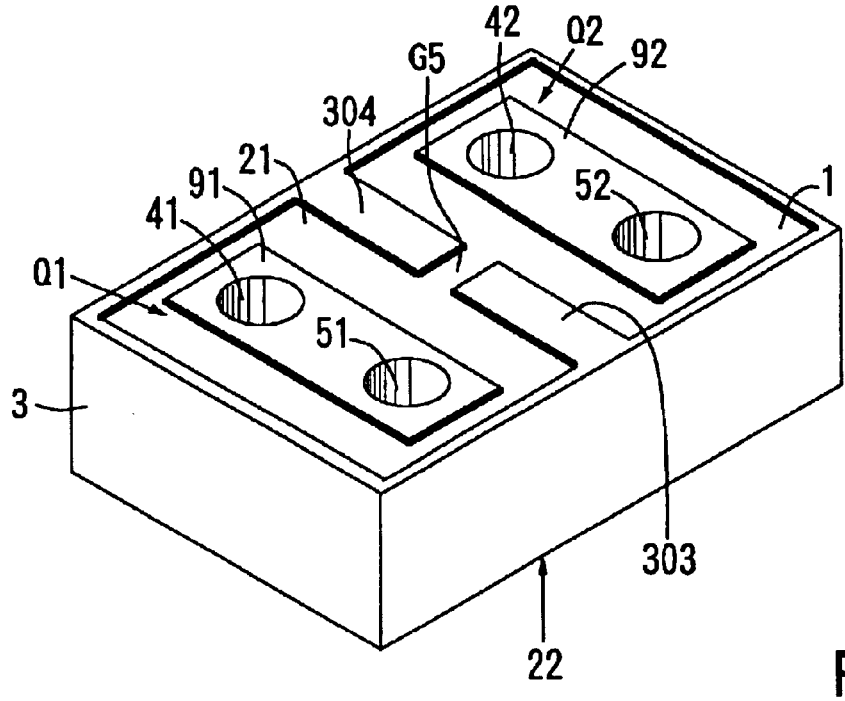
FIG. 11 is a perspective view illustrating still another embodiment of the dielectric filter in accordance with the present invention.

FIG. 11 is a perspective view illustrating yet another embodiment of the dielectric filter in accordance with the present invention. A specific feature of the embodiment shown in FIG. 11 is in that the conductor films 303, 304 provided between adjacent resonator units Q1, Q2 extend inward from the mutually opposite side surfaces and are separated by an insulating gap G5 provided in the intermediate portion. With such structure, the inductive coupling between adjacent resonator units Q1, Q2 can be adjusted by selecting the size of insulating gap G5.

Figure 12:
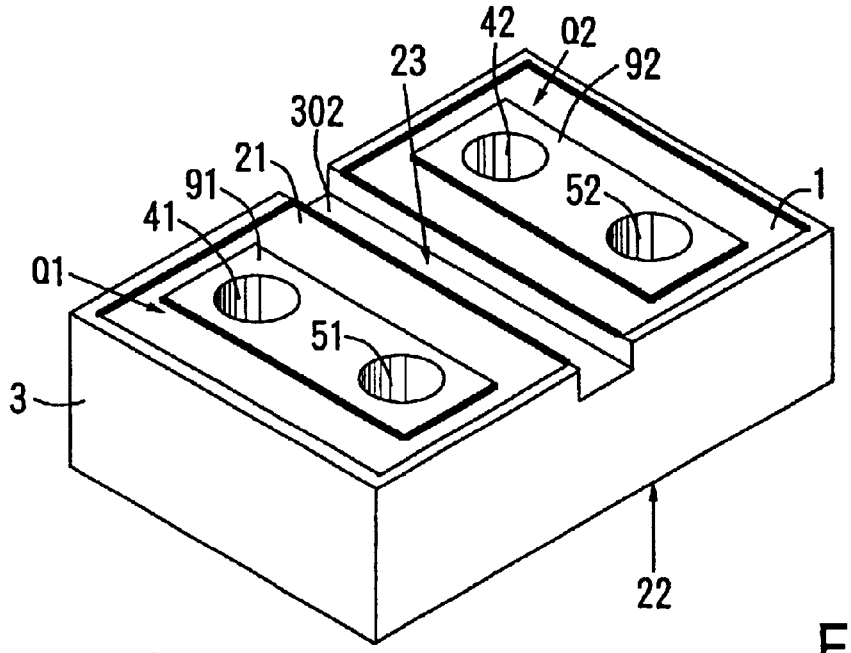
FIG. 12 is a perspective view illustrating yet another embodiment of the dielectric filter in accordance with the present invention.

FIG. 12 is a perspective view illustrating still another embodiment of the dielectric filter in accordance with the present invention. In this embodiment, a recess 23 is provided between adjacent resonator units Q1, Q2 and a conductor film 302 connected to external conductor film 3 is provided on the bottom surface and inner side surfaces of recess 23. Conductor film 302 can be formed by coating, fitting, or plating an electrically conductive material containing Cu, Ag and the like as the main component on the inner surface of recess 23. With such structure, the inductive coupling between adjacent resonator units Q1, Q2 can be adjusted by selecting the position, width, depth, and length of recess 23.

Figure 13:
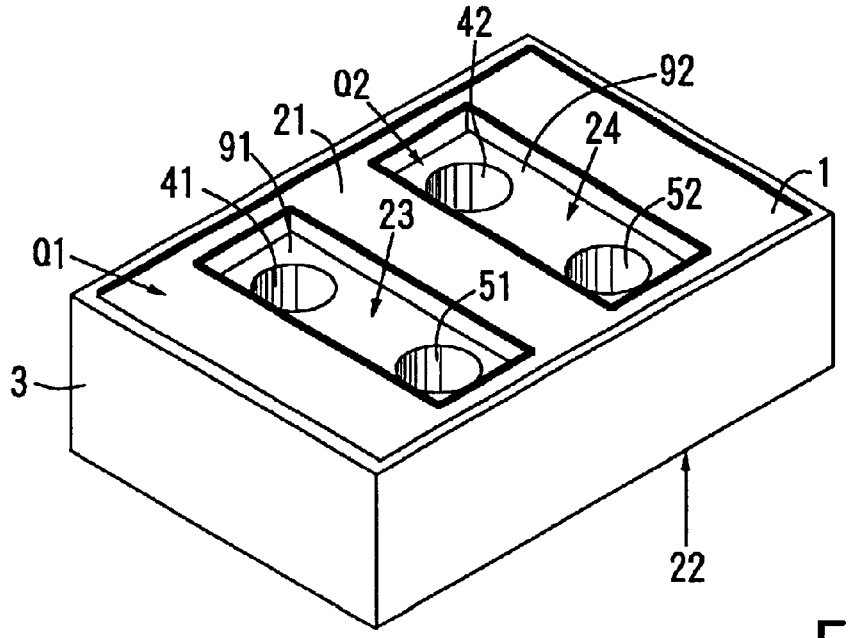
FIG. 13 is a perspective view illustrating still another embodiment of the dielectric filter in accordance with the present invention.

FIG. 13 is a perspective view illustrating still another embodiment of the dielectric filter in accordance with the present invention. A specific feature of the embodiment shown in FIG. 13 is that resonator units Q1, Q2 comprise respective recesses 23, 24. Recesses 23, 24 are formed so as to be spaced apart in end surface 21. First hole 41 and second hole 51 constituting resonator unit Q1 are provided inside recess 23, and first hole 42 and second hole 52 constituting resonator unit Q2 are provided inside recess 24. Furthermore, a conductor film 91 is formed on the bottom surface and vertical surfaces of recess 23, and conductor film 92 is formed on the bottom surface and vertical surfaces of recess 24. In the embodiment shown in FIG. 13, too, resonator unit Q1 and resonator unit Q2 are capacitively coupled to each other.

Figure 14:
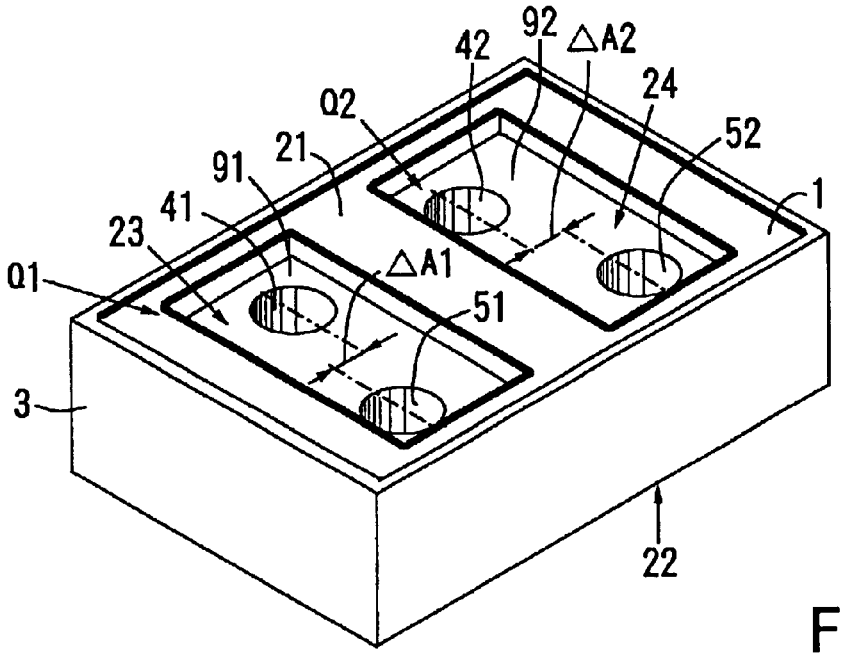
FIG. 14 is a perspective view illustrating yet another embodiment of the dielectric filter in accordance with the present invention.
Figure 15:
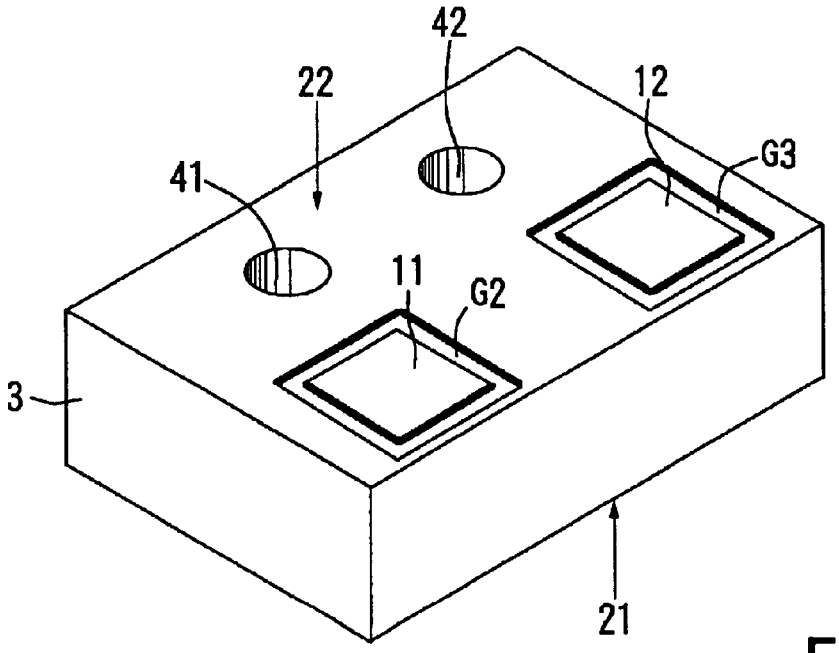
FIG. 15 is a perspective view of the dielectric filter shown in FIG. 14, as viewed from the bottom surface thereof.

FIG. 14 is a perspective view illustrating another embodiment of the dielectric filter in accordance with the present invention. FIG. 15 is a bottom surface view of the dielectric filter shown in FIG. 14.

A specific feature of the embodiment shown in the figures is in the arrangement of first hole 41 and second hole 51 inside recess 23 and the arrangement of first hole 42 and second hole 52 inside recess 24. Thus, second hole 51 is displaced outward by a dimension ΔA1 with respect to first hole 41, and second hole 52 is displaced outward by a dimension ΔA2 with respect to first hole 42.

As shown in FIG. 15, first terminal 11 corresponding to second hole 51 and second terminal 12 corresponding to second hole 52 are also shifted outward with respect to first holes 41, 42.

In case of the embodiment illustrated by FIGS. 14 and 15, resonator unit Q1 and resonator unit Q2 are capacitively coupled to each other. The embodiment illustrated by FIGS. 14 and 15 shows that the capacitive coupling of resonator unit Q1 and resonator unit Q2 can be adjusted by selecting the dimension ΔA1.

Figure 16:
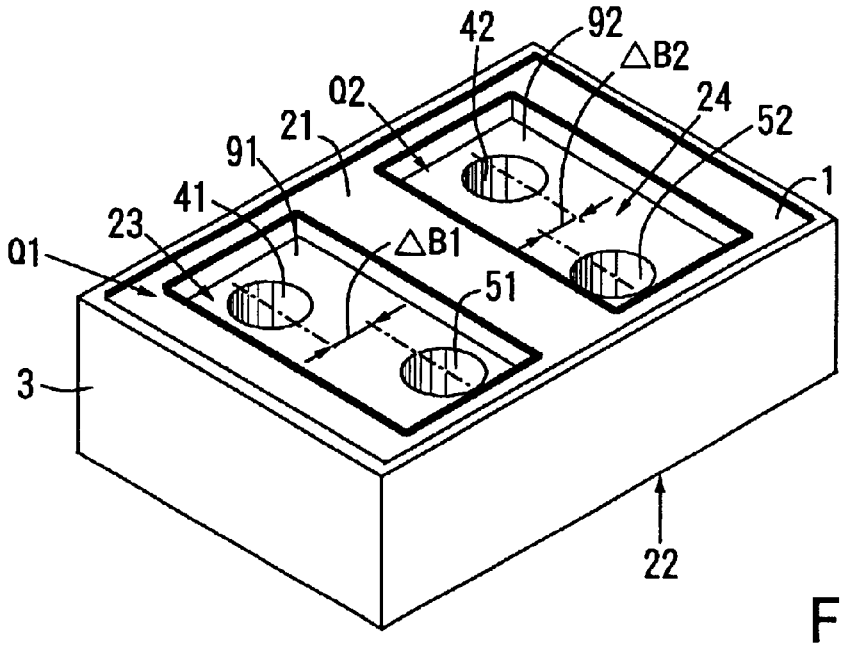
FIG. 16 is a perspective view illustrating yet another embodiment of the dielectric filter in accordance with the present invention.
Figure 17:
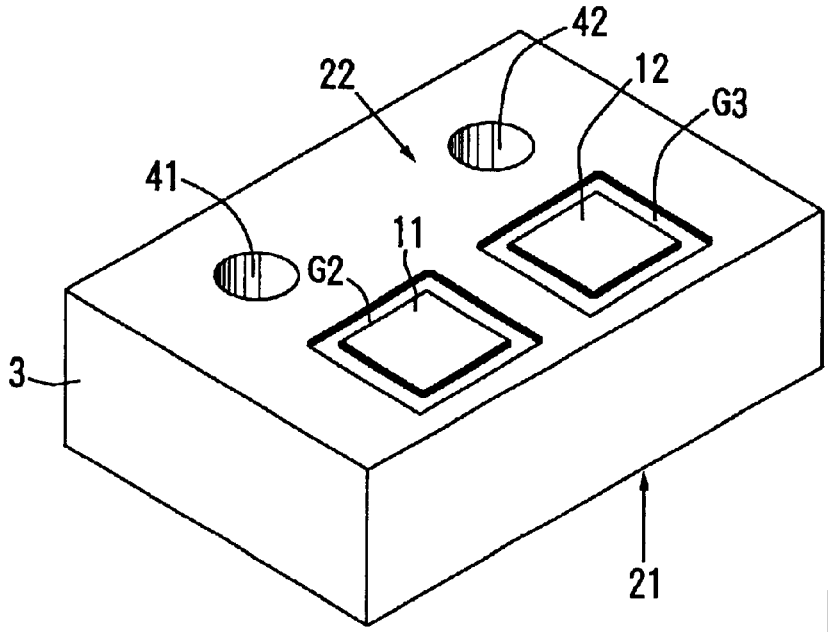
FIG. 17 is a perspective view of the dielectric filter shown in FIG. 16, as viewed from the bottom surface thereof.

FIG. 16 is a perspective view illustrating another embodiment of the dielectric fitter in accordance with the present invention. FIG. 17 is a bottom surface view of the dielectric filter shown in FIG. 16. A specific feature of the embodiment shown in the figures is in the arrangement of first hole 41 and second hole 51 inside recess 23 and the arrangement of first hole 42 and second hole 52 inside recess 24. Thus, second hole 51 is displaced inward by a dimension ΔB1 with respect to first hole 41, and second hole 52 is displaced inward by a dimension Δb2 with respect to first hole 42.

As shown in FIG. 17, first terminal 11 corresponding to second hole 51 and second terminal 12 corresponding to second hole 52 are also displaced inward with respect to first holes 41, 42. In case of the embodiment illustrated by FIGS. 16 and 17, resonator unit Q1 and resonator unit Q2 are capacitively coupled to each other. The embodiment illustrated by FIGS. 16 and 17 shows that the capacitive coupling of resonator unit Q1 and resonator unit Q2 can be adjusted by selecting the dimension ΔB1. FIGS. 16 and 17 illustrate a case in which the positions of second holes 51, 52 are moved so that they approach each other, thereby intensifying coupling of resonator units Q1, Q2.

By further advancing the embodiments illustrated by FIGS. 14 to 17, it is also possible to implement a structure in which first hole 41 and second hole 51, and/or first hole 42 and second hole 52, and first hole 41 and second hole 51, and/or first hole 42 and second hole 52 are arranged in a row along the direction of resonator units Q1, Q2 arrangement.

Figure 18:
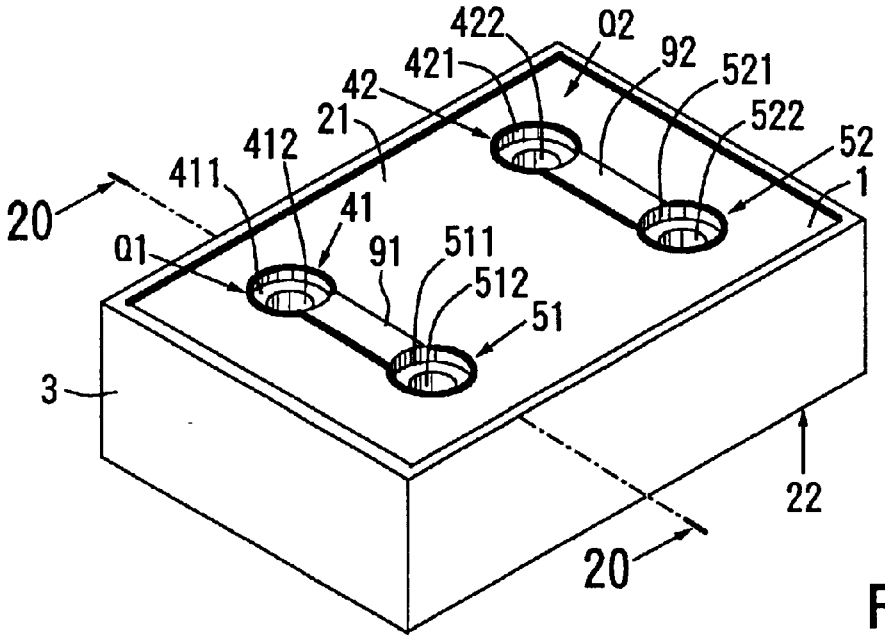
FIG. 18 is a perspective view illustrating yet another embodiment of the dielectric filter in accordance with the present invention.
Figure 19:
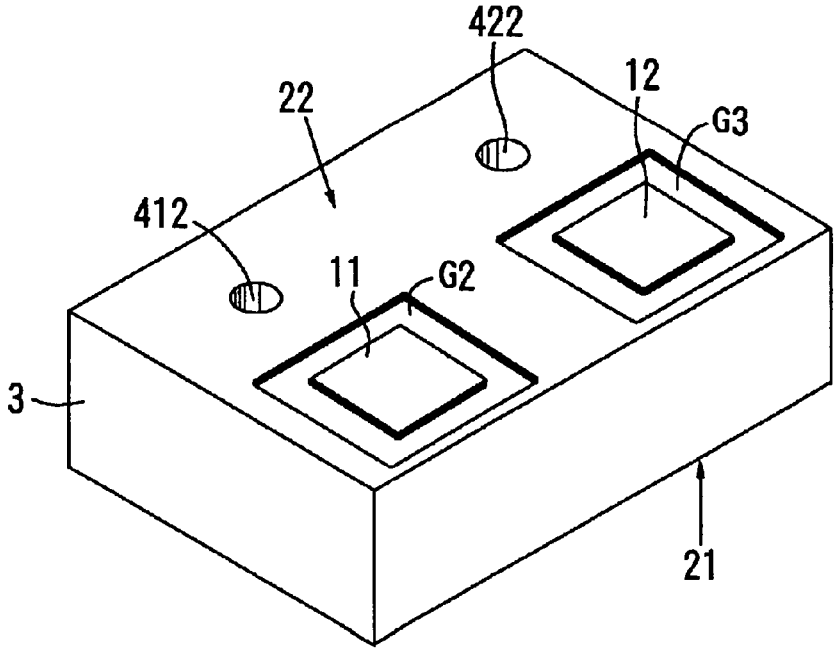
FIG. 19 is a perspective view of the dielectric filter shown in FIG. 18, as viewed from the bottom surface thereof.
Figure 20:
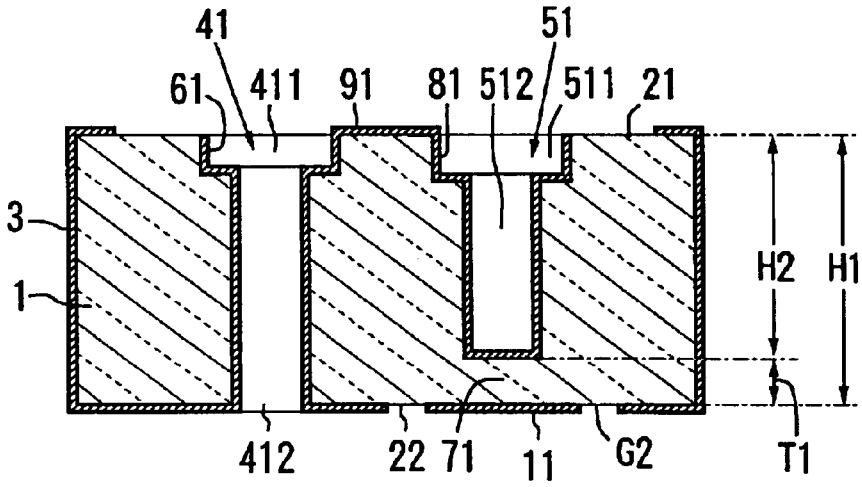
FIG. 20 is a cross-sectional view along line 20—20 in FIG. 18.

FIG. 18 is a perspective view illustrating another embodiment of the dielectric filter in accordance with the present invention. FIG. 19 is a bottom surface view of the dielectric filter shown in FIG. 18. FIG. 20 is a cross-sectional view along line 20—20 in FIG. 18.

In the embodiment shown in the figures, first hole 41 comprises a large-diameter portion 411 and a small-diameter portion 412. Large-diameter portion 411 is open at end surface 21 and small-diameter portion 412 is connected to the lower part of large-diameter portion 411. First hole 42 also comprises a large-diameter portion 421 and a small-diameter portion 422. Large-diameter portion 421 is open at end surface 21 and small-diameter portion 422 is connected to the lower part of large-diameter portion 421. In first holes 41, 42, as shown in FIGS. 19 and 20, small-diameter portions 412, 422 are open at opposite surface 22 of dielectric substrate 1.

In the embodiment shown in FIGS. 18 to 20, second holes 51, 52 also comprise large-diameter portions 511, 521 and small-diameter portions 512, 522. Large-diameter portions 511, 521 are open at the end surface and small-diameter portions 512, 522 are connected to the lower parts of large-diameter portions 511, 521 and front ends thereof are closed.

External conductor film 3 is provided on opposite surface 22, and first terminal 11 and second terminal 12 are provided in the positions corresponding to small-diameter portions 512, 522 of second holes 51, 52. First terminal 11 and second terminal 12 are electrically insulated from external conductor film 3 by insulating gaps g2, g3.

In case of the embodiment shown in FIGS. 18 to 20, the coupling characteristic between resonator unit Q1 and resonator unit Q2 and the resonant frequencies can be adjusted by selecting the diameter of large-diameter portions (411, 421), (511, 521).

Figure 21:
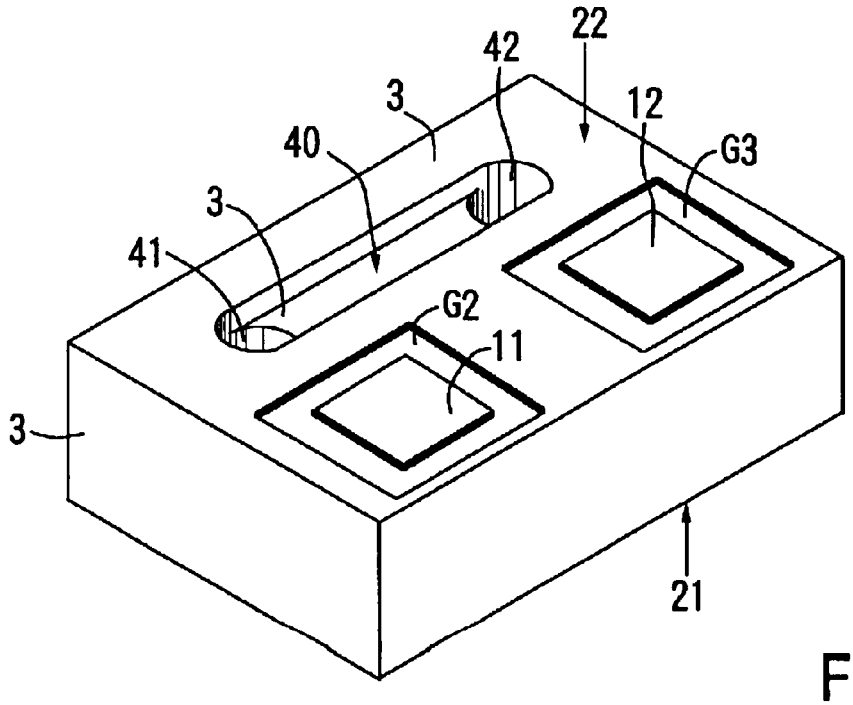
FIG. 21 is a perspective view illustrating yet another embodiment of the dielectric filter in accordance with the present invention.

FIG. 21 is a perspective view illustrating another embodiment of the dielectric filter in accordance with the present invention. In this embodiment, a trench 40 connecting first holes 41, 42 open at opposite surface 22 is provided therebetween. External conductor film 3 is formed on the inner surface of trench 40. With such embodiment, coupling of resonator units Q1, Q2 can be adjusted by selecting, for example, the depth or width of trench 40.

Figure 22:
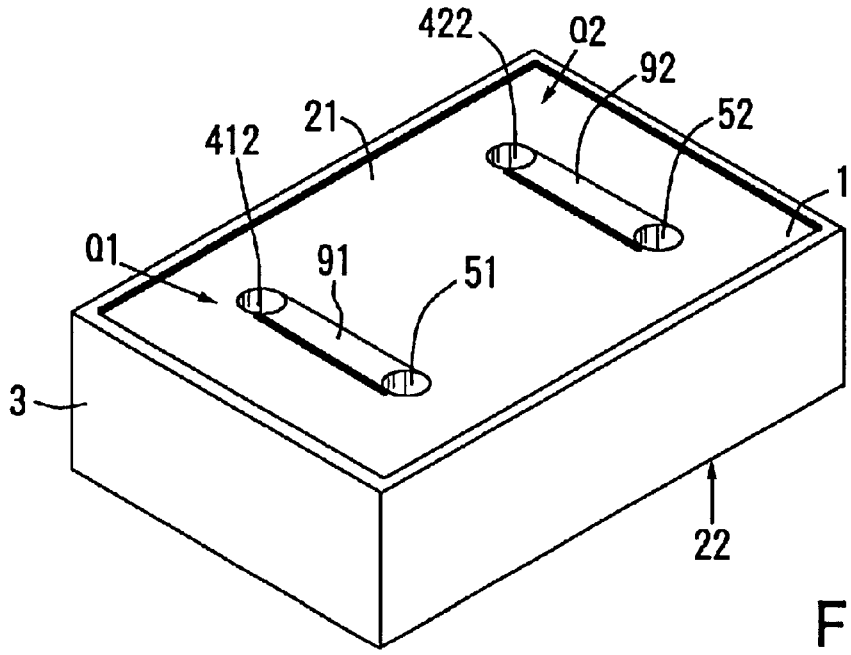
FIG. 22 is a perspective view illustrating yet another embodiment of the dielectric filter in accordance with the present invention.
Figure 23:
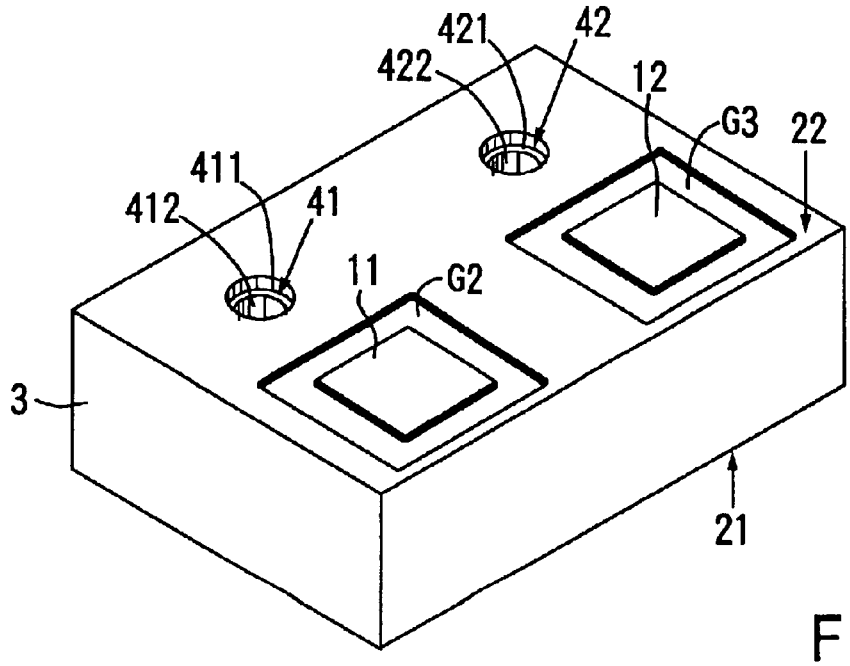
FIG. 23 is a perspective view of the dielectric filter shown in FIG. 22, as viewed from the bottom surface thereof.

FIG. 22 is a perspective view illustrating still another embodiment of the dielectric filter in accordance with the present invention. FIG. 23 is a bottom surface view of the dielectric filter shown in FIG. 22.

In the embodiment shown in the figures, large-diameter portion 411 is open at opposite surface 22, and small-diameter portion 412 is connected to the upper part of large-diameter portion 411, that is, in the direction of end surface 21. First hole 42 also comprises large-diameter portion 421 and small-diameter portion 422. Large-diameter portion 421 is open at opposite surface 22, and small-diameter portion 422 is connected to the upper part of large-diameter portion 421. In first holes 41, 42, as shown in FIG. 22, small-diameter portions 412, 422 are open at end surface 21 of dielectric substrate 1.

External conductor film 3 is provided at opposite surface 22. First terminal 11 and second terminal 12 are also provided on the opposite surface in the positions corresponding to second holes 51, 52. First terminal 11 and second terminal 12 are electrically insulated from external conductor film 3 by insulating gaps g2, g3.

In case of the embodiment illustrated by FIGS. 22 and 23, the coupling characteristic between resonator unit Q1 and resonator unit Q2 and the resonant frequencies thereof can be adjusted by selecting the diameter of large-diameter portions 411, 421.

Figure 24:
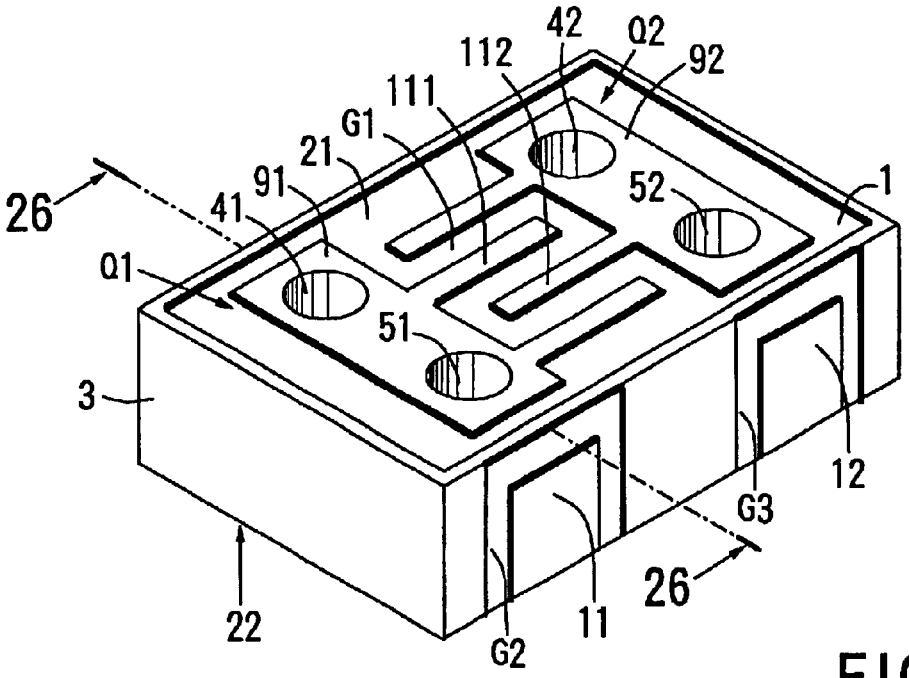
FIG. 24 is a perspective view illustrating yet another embodiment of the dielectric filter in accordance with the present invention.
Figure 25:
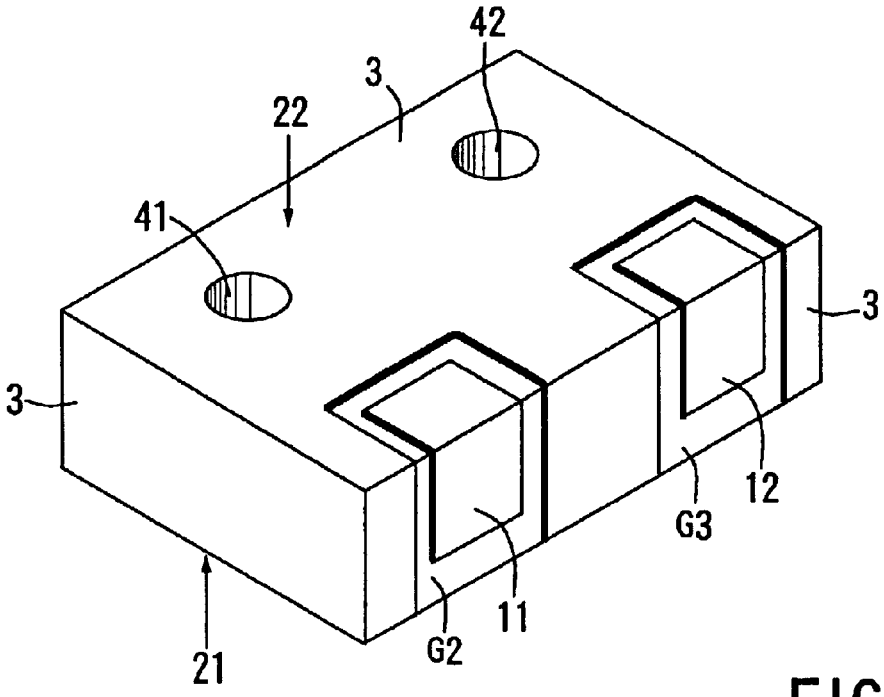
FIG. 25 is a perspective view of the dielectric filter shown in FIG. 24, as viewed from the bottom surface thereof.
Figure 26:
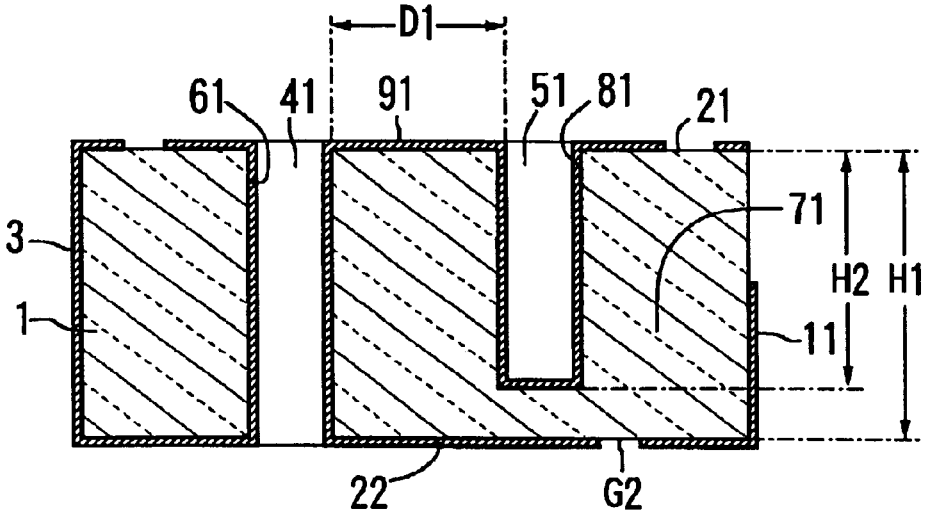
FIG. 26 is a cross-sectional view along line 26—26 in FIG. 24.

FIG. 24 is a perspective view illustrating another embodiment of the dielectric filter in accordance with the present invention. FIG. 25 is a perspective view of the dielectric filter shown in FIG. 24, as viewed from the bottom surface thereof. FIG. 26 is a cross-sectional view along line 26—26 in FIG. 24. A specific feature of the embodiment shown in the figures is in that first terminal 11 and second terminal 12 are formed consecutively on the side surface and opposite surface 22 of dielectric substrate 1.

First terminal 11 is electrically insulated from external conductor film 3 by gap g2 and, as shown in FIG. 26, capacitively coupled to internal conductor 81 of second hole 51 via dielectric portion 71. Second terminal 12 is electrically insulated from external conductor film 3 by gap g3 and is capacitively coupled to the internal conductor of second hole 52 via a dielectric portion.

Various embodiments can be considered when first terminal 11 and second terminal 12 are provided on the side surface of dielectric substrate 1. An example thereof is shown in FIGS. 27 and 28.

Figure 27:
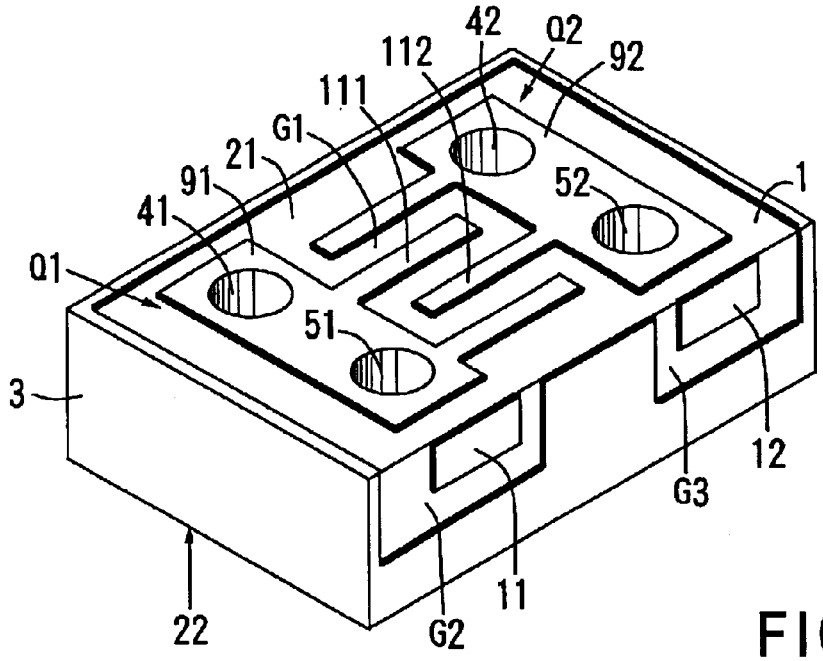
FIG. 27 is a perspective view illustrating yet another embodiment of the dielectric filter in accordance with the present invention.

In the embodiment shown in FIG. 27, first terminal 11 and second terminal 12 are provided on the side surface of dielectric substrate 1 so that the upper edges thereof are aligned with end surface 21.

Figure 28:
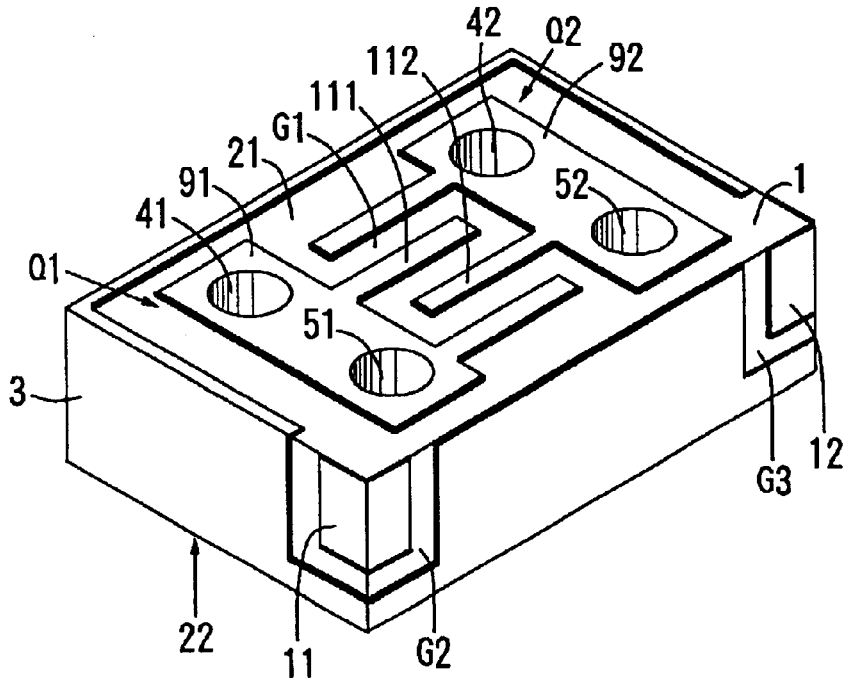
FIG. 28 is a perspective view illustrating yet another embodiment of the dielectric filter in accordance with the present invention.

In the embodiment shown in FIG. 28, first terminal 11 and second terminal 12 are provided on two side surfaces constituting a corner of dielectric substrate 1 so that the upper edges thereof are aligned with end surface 21.

When the dielectric filter shown in FIGS. 27 and 28 is mounted onto a substrate, surface mounting can be conducted by arranging a side surface where both the first terminal 11 and the second terminal 12 are present so that it faces the substrate.

Figure 29:
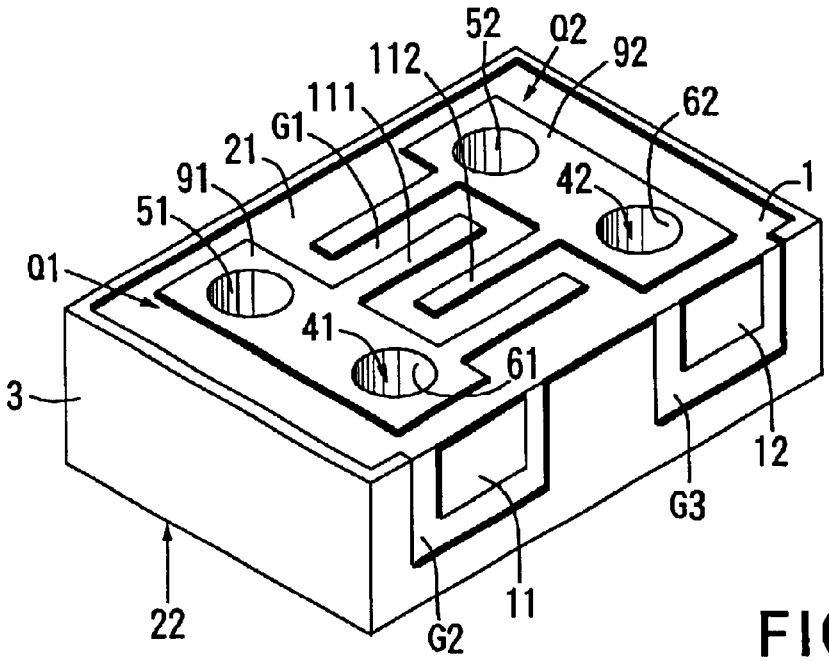
FIG. 29 is a perspective view illustrating yet another embodiment of the dielectric filter in accordance with the present invention.
Figure 30:
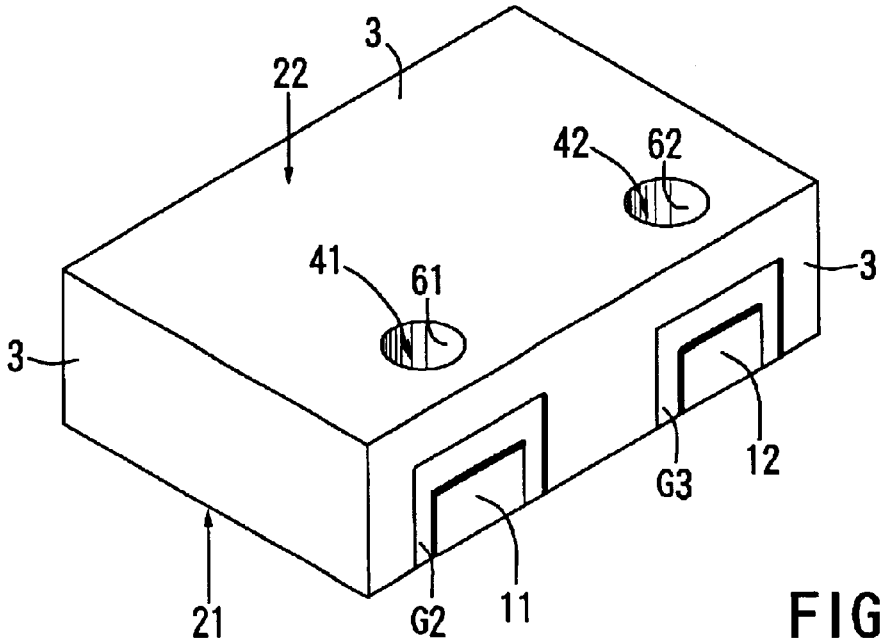
FIG. 30 is a perspective view of the dielectric filter shown in FIG. 29, as viewed from the bottom surface thereof.

FIG. 29 is a perspective view illustrating yet another embodiment of the dielectric filter in accordance with the present invention. FIG. 30 is a perspective view of the dielectric filter shown in FIG. 29, as viewed from the bottom surface thereof. In the embodiment shown in the figures, first terminals 11, 12 electrically insulated from external conductor film 3 by insulating gaps g2, g3 are provided on the side surface of dielectric substrate 1, and first terminals 11, 12 are capacitively coupled to first internal conductors 61, 62 located inside first holes 41, 42.

FIGS. 1 to 30 teach to provide first terminal 11 and second terminal 12 on the bottom or side surface of dielectric substrate 1. However, those examples are not limiting and a structure may be used in which first terminal 11 and second terminal 12 are provided on end surface 21.

Figure 31:
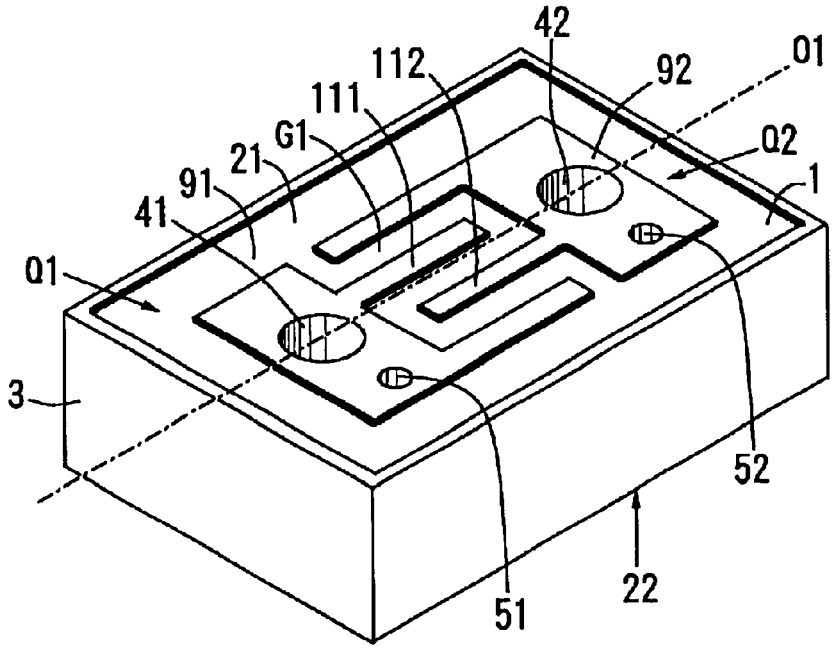
FIG. 31 is a perspective view illustrating yet another embodiment of the dielectric filter in accordance with the present invention.
Figure 32:
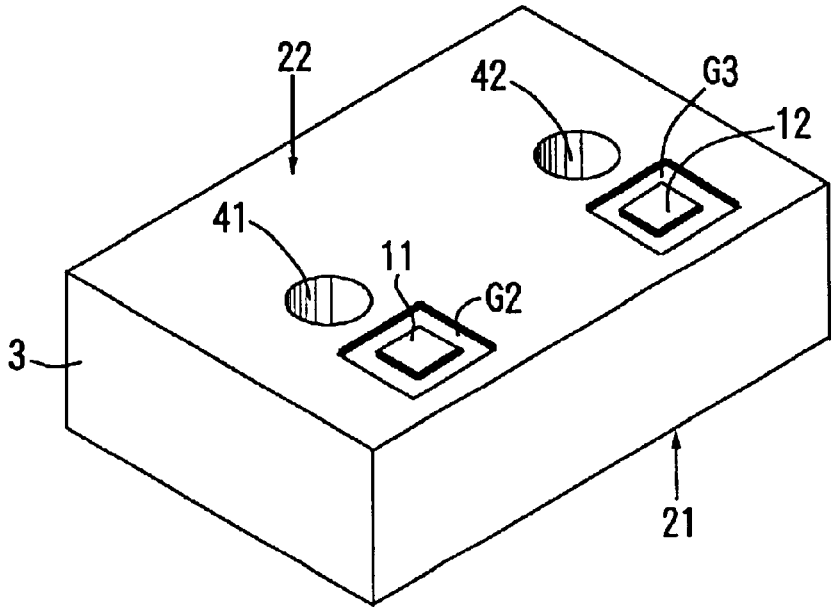
FIG. 32 is a perspective view of the dielectric filter shown in FIG. 31, as viewed from the bottom surface thereof.

FIG. 31 is a perspective view illustrating yet another embodiment of the dielectric filter in accordance with the present invention. FIG. 32 is a perspective view of the dielectric filter shown in FIG. 31, as viewed from the bottom surface thereof. In this embodiment, first holes 41, 42 are provided almost on a central line (center in the width direction) O1 of dielectric substrate 1. The diameter of second holes 51, 52 is less than that of first holes 41, 42. This embodiment demonstrates that it is not necessary to provide symmetry for the arrangement of first holes 41, 42 and second holes 51, 52 and the diameter shape thereof.

In any of the dielectric filters shown in FIGS. 8 to 32, the internal structure of the dielectric filter is substantially identical to that of the dielectric filters shown in FIGS. 1 to 4. Therefore, it is clear that the operation and effect of all of the dielectric filters shown in FIGS. 8 to 32 are the same as in the embodiments illustrated by FIGS. 1 to 4.

Figure 33:
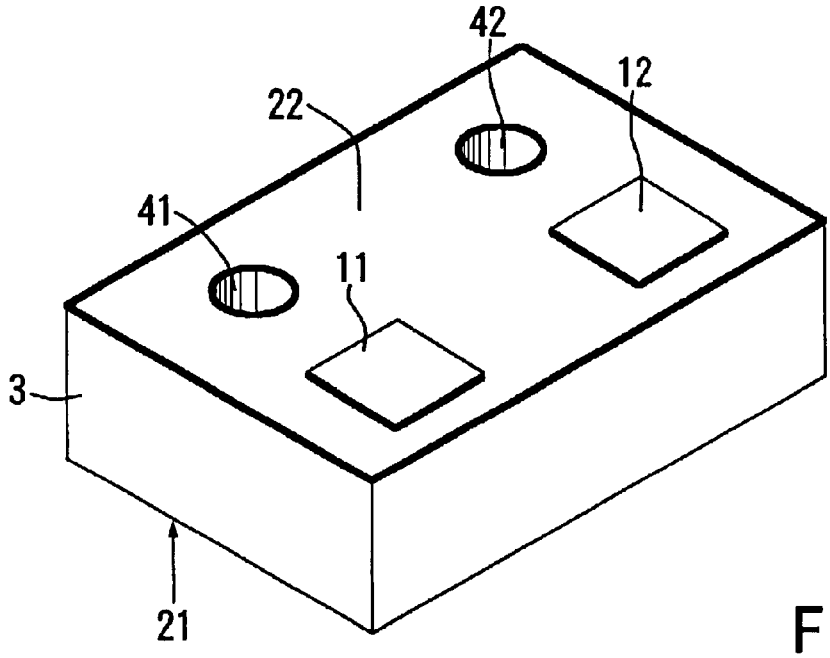
FIG. 33 is a perspective view illustrating yet another embodiment of the dielectric filter in accordance with the present invention.

FIG. 33 is a perspective view illustrating still another embodiment of the dielectric filter in accordance with the present invention. FIG. 33 is a perspective view, as viewed from the bottom surface. The structure of the upper surface can be the same as shown in FIGS. 1 to 31.

A specific feature of the embodiment shown in FIG. 33 is in that a dielectric filter with a resonant wavelength ($\lambda/2$) is adopted, whereas in the embodiments shown in FIGS. 1 to 32, a dielectric filter with a resonant wavelength ($\lambda/4$) is adopted. The dielectric filter with a resonant wavelength ($\lambda/2$) comprises not only the inherent end surface 21, but one more end surface composed by surface 22 opposite thereto which has no external conductor film 3. First holes 41, 42 are open at opposite surface 22 serving as an end surface. First and second terminals 11, 21 are formed on opposite surface 22 opposite to the second hole which is not shown in FIG. 33.

Figure 34:
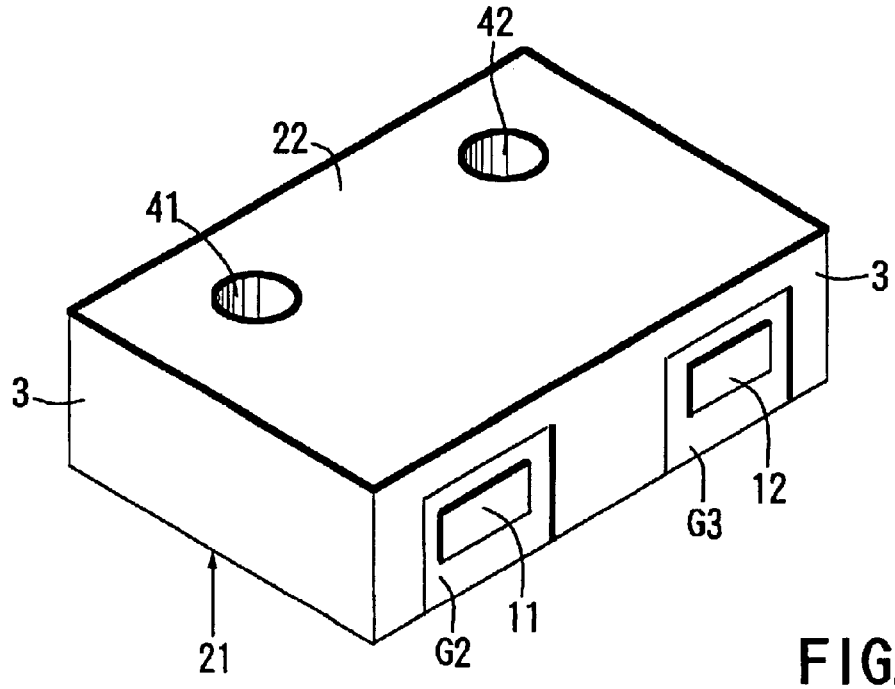
FIG. 34 is a perspective view illustrating yet another embodiment of the dielectric filter in accordance with the present invention.

FIG. 34 is a perspective view illustrating yet another embodiment of the dielectric filter in accordance with the present invention. FIG. 34 is a perspective view, as viewed from the bottom surface. In the figure, structural components identical to those shown in FIG. 33 are assigned with the same reference symbols. Similarly to the embodiment shown in FIG. 33, the upper surface can have a structure shown in FIGS. 1 to 31. A common feature of this embodiment and the embodiment shown in FIG. 33 is in that a dielectric filter with a resonant wavelength ($\lambda/2$) is adopted.

A specific feature of the embodiment shown in FIG. 34 is in that first hole 11 and second terminal 12 are provided in the intermediate portions on the side surface of dielectric substrate 1, excluding end surface 21 and opposite surface 22. First and second terminals 11, 12 can assume a variety of configurations as shown in the preceding figures. In the embodiment shown in FIGS. 33 and 34, the upper surface can have a structure shown in FIGS. 1 to 32. Furthermore, this embodiment is also identical to the above-described embodiments in terms of the presence of the second hole. Therefore, it is clear that with the embodiments shown in FIG. 33 and FIG. 34, the object of the present invention can be attained in a dielectric filter with a resonant wavelength ($\lambda/2$).

Figure 35:
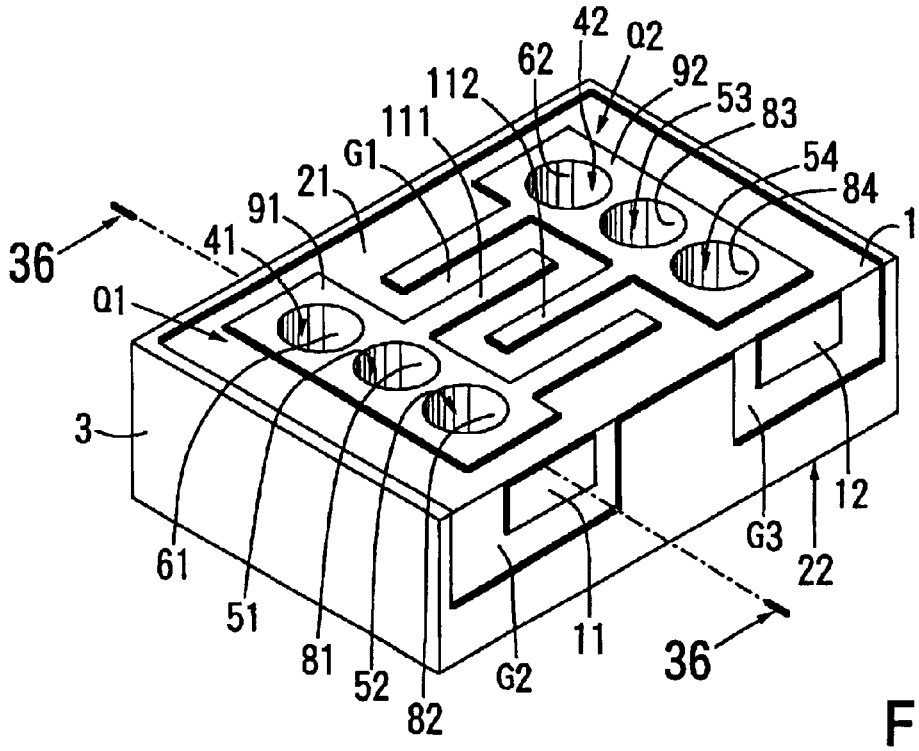
FIG. 35 is a perspective view illustrating yet another embodiment of the dielectric filter in accordance with the present invention.
Figure 36:
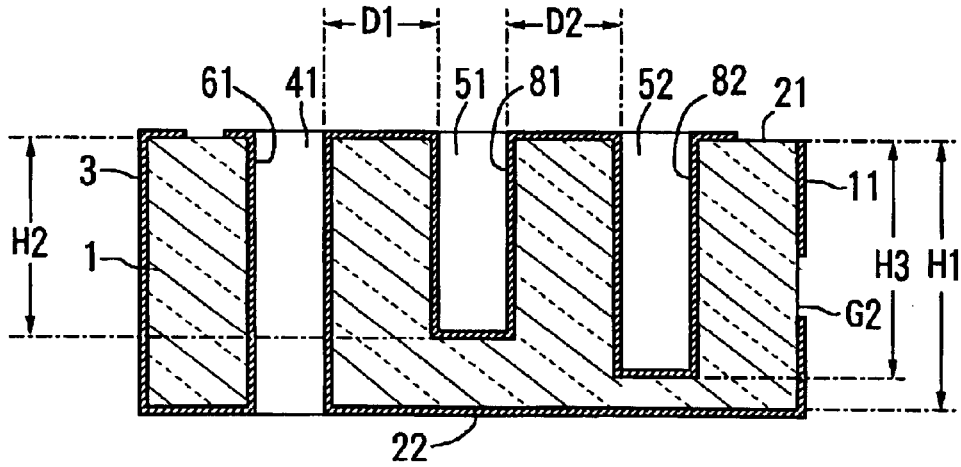
FIG. 36 is a cross-sectional view along line 36—36 in FIG. 35.

FIG. 35 is a perspective view illustrating still another embodiment of the dielectric filter in accordance with the present invention. FIG. 36 is a cross-sectional view along tine 36—36 in FIG. 35. In this embodiment, resonator unit Q1 comprises first hole 41 and two second holes 51, 52. First hole 41 is a through hole, and second holes 51, 52 are blind holes; the holes are disposed at distances D1, D2. First internal conductor 61 and second internal conductors 81, 82 provided inside first hole 41 and second holes 51, 52 are connected to conductor film 91.

Resonator unit Q2 has the same structure as resonator unit Q1. Thus, resonator unit Q2 comprises a first hole 42 and two second holes 53, 54. First hole 42 is a through hole, and second holes 53, 54 are blind holes; the holes are disposed at distances D1, D2. First internal conductor 62 and second internal conductors 83, 84 provided inside first hole 42 and second holes 53, 54 are connected to conductor film 92.

First terminal 11 and second terminal 12 are provided on the side surface of dielectric substrate 1. First terminal 11 is capacitively coupled to second internal conductor 82 provided in second hole 52, and second terminal 12 is capacitively coupled to second internal conductor 84 provided in second hole 54.

Figure 37:
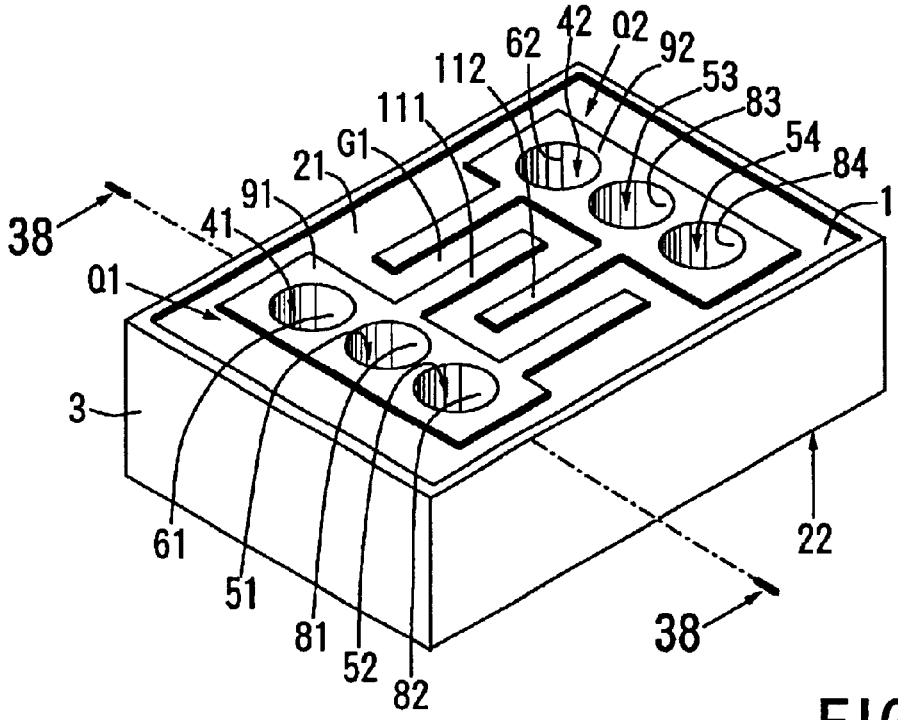
FIG. 37 is a perspective view illustrating yet another embodiment of the dielectric filter in accordance with the present invention.
Figure 38:
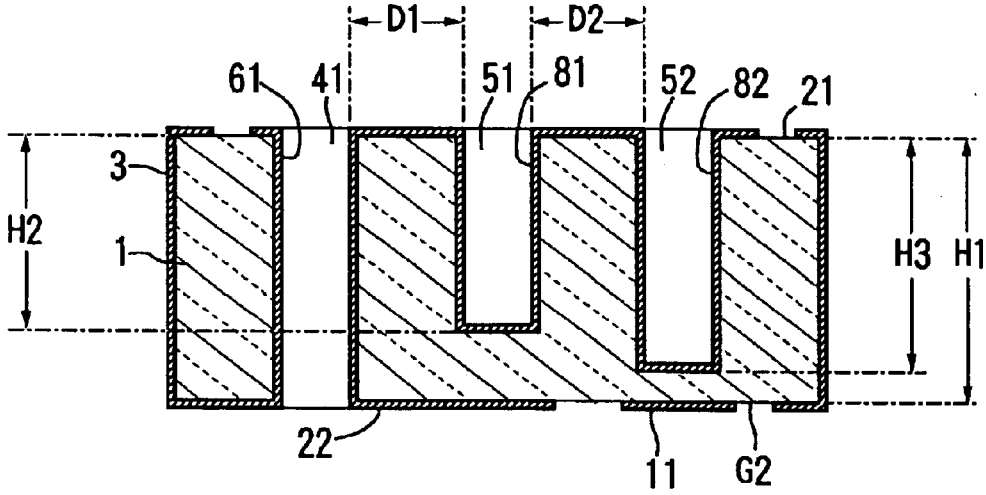
FIG. 38 is a cross-sectional view along line 38—38 in FIG. 37.

FIG. 37 is a perspective view illustrating yet another embodiment of the dielectric filter in accordance with the present invention. FIG. 38 is a cross-sectional view along line 38—38 in FIG. 37. The dielectric filter shown in FIGS. 37 and 38 is different from the dielectric filter of the embodiment shown in FIGS. 35 and 36 only in that first terminal 11 and second terminal 12 are provided on opposite surface 22 of dielectric substrate 1. As explained above, first terminal 11 and second terminal 12 can assume various arrangements and positions in addition to those shown in FIGS. 35 to 38.

In FIGS. 35 to 38, the depth H2 of second hole 51 of resonator unit Q1 and second hole 53 of resonator unit Q2 is less than the depth H3 of second hole 52 of resonator unit Q1 and second hole 54 of resonator unit Q2 ($H2<H3$), but the inverse relationship ($H2>H3$) is also possible. The depths H2, H3 are not necessarily the same in resonator units Q1, Q2.

Figure 39:
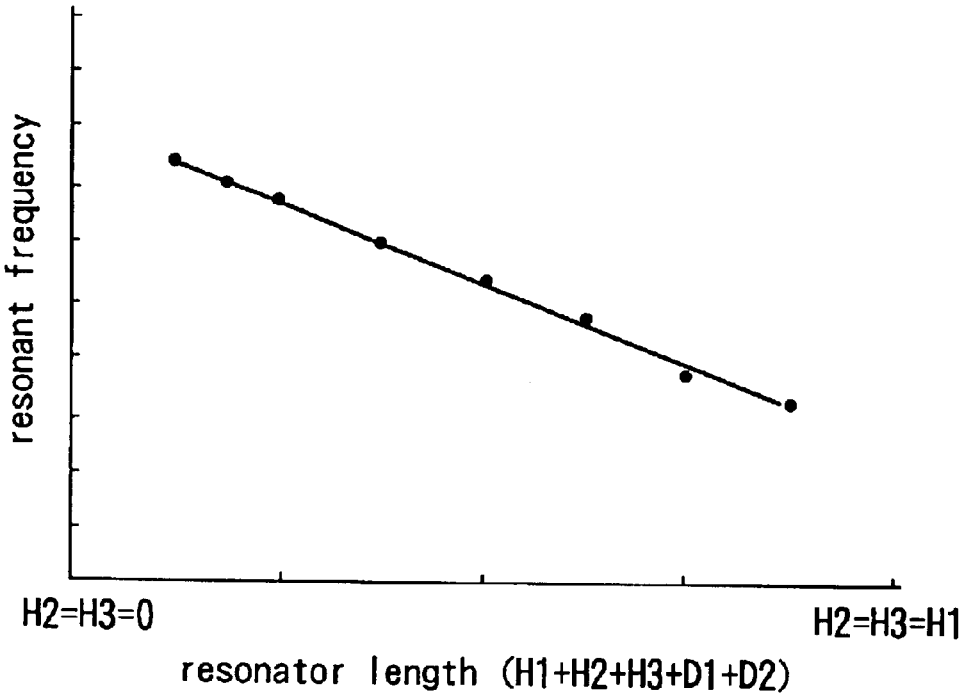
FIG. 39 illustrates the relationship between the resonant frequency and resonator length of the dielectric filter shown in FIGS. 35 to 38.

FIG. 39 illustrates the relationship between the resonant frequency and resonator length in the dielectric fitter shown in FIGS. 35 to 38. In the figure, the resonator length ($H1+H2+H3+D1+D2$) is plotted against the abscissa and the resonant frequency is plotted against the ordinate. As shown in FIG. 39, in resonator unit Q1, the resonant frequency changes linearly when the depth H2, H3 of second holes 51, 52 changes from $H2=H3=0$ to $H2=H3=H1$. Therefore, it is clear that the resonant frequency can be adjusted by changing the depth H2, H3 of second holes 51, 52.

Since first hole 41 and second holes 51, 52 are successively disposed at distances D1, D2 form each other, the resonant frequency can be also adjusted by setting the distances D1, D2. It is obvious that the same result can be obtained in resonator unit Q2, and the explanation is omitted. Furthermore, it is not necessary that each of resonator units Q1, Q2 be provided with two of second holes 51 to 54 and more holes may be provided.

In the above-described embodiments, dielectric filters with two resonator units Q1, Q2 were described, but the dielectric filter may have any number of resonator units. Specific examples of dielectric filters with increased number of resonator units are described below.

Figure 40:
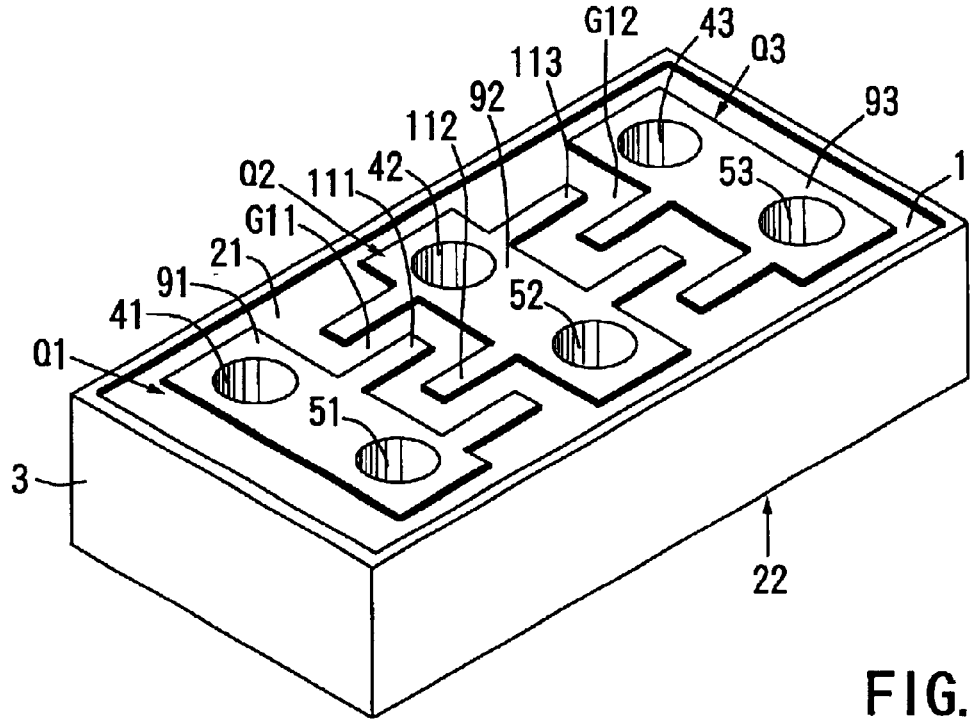
FIG. 40 is a perspective view illustrating yet another embodiment of the dielectric filter in accordance with the present invention.
Figure 41:
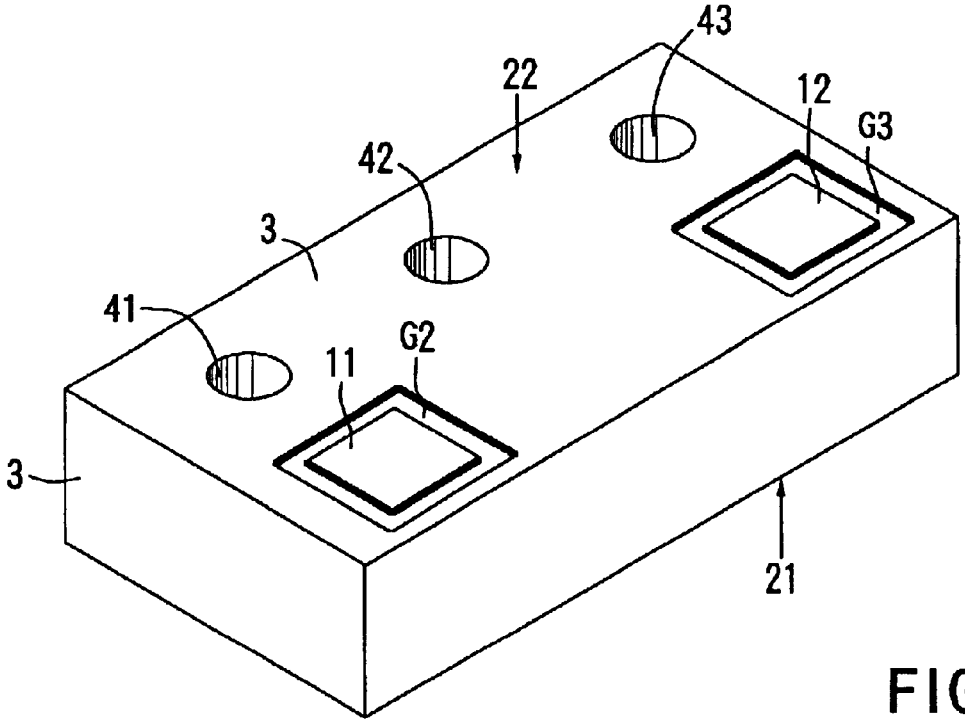
FIG. 41 is a perspective view of the dielectric filter shown in FIG. 40, as viewed from the bottom surface thereof.

FIG. 40 is a perspective view illustrating a dielectric filter having three resonator units Q1, Q2, Q3. FIG. 41 is a perspective view of the dielectric filter shown in FIG. 40, as viewed from the bottom surface thereof.

Resonator units Q1, Q2, Q3 use a common dielectric substrate 1 and are integrated via dielectric substrate 1. External conductor film 3 covers a large portion of the outer surface of dielectric substrate 1, except one surface serving as end surface 21.

Resonator unit Q1 comprises first hole 41 and second hole 51. Resonator unit Q2 comprises first hole 42 and second hole 52. Resonator unit Q3 comprises first hole 43 and second hole 53. Individual structures of first holes 41 to 43 and second holes 51 to 53 and mutual arrangement thereof correspond to those explained with reference to FIGS. 1 to 4.

Resonator unit Q1 and resonator unit Q2 are capacitively coupled via coupling electrode 111 and coupling electrode 112, and resonator unit Q2 and resonator unit Q3 are capacitively coupled via coupling electrode 112 and coupling electrode 113.

First terminal 11 is disposed in a position corresponding to second hole 51 in surface 22 opposite to end surface 21 in a state in which it is electrically insulated from external conductor film 3 by insulating gap G2.

Second terminal 12 is disposed in a position corresponding to second hole 53 in opposite surface 22 in a state in which it is electrically insulated from external conductor film 3 by insulating gap G3.

In the embodiment shown in FIGS. 40 and 41, a larger number of resonator units Q1 to Q3 are used. Therefore, the frequency selection characteristic is improved.

Figure 42:
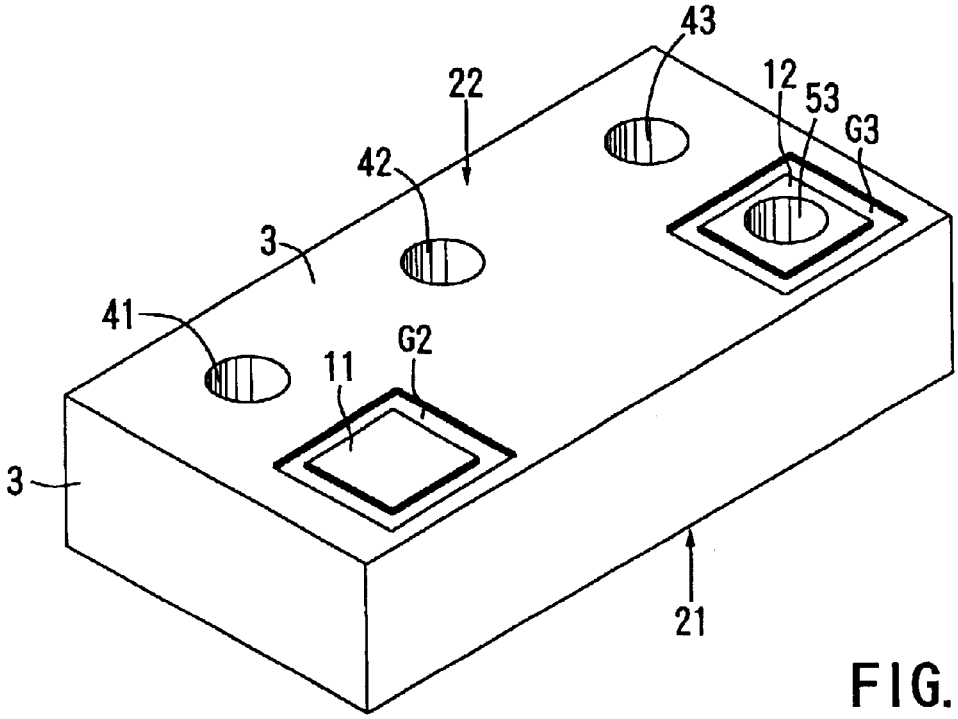
FIG. 42 is a perspective view illustrating yet another embodiment of the dielectric filter in accordance with the present invention.

FIG. 42 illustrates yet another embodiment of the dielectric filter in accordance with the present invention. FIG. 42 shows a modification of the dielectric filter having the surface structure shown in FIG. 40, wherein second hole 53 shown in FIG. 40 is a through hole. Second terminal 12 is directly connected to the internal conductor of this second hole 53 at opposite surface 22. Second terminal 12 is electrically insulated from external conductor film 3 by insulating gap G3. First terminal film 11 electrically insulated from external conductor film 3 by insulating gap G2 is provided in a position corresponding to second hole 51 among second holes 51, 52 (see FIG. 40) provided in resonator units Q1, Q2.

In the embodiment shown in FIG. 42, second terminal 12 is connected directly to the internal conductor of second hole 53 provided in resonator unit Q3, at opposite surface 22. Therefore, resonator unit Q3 acts as a resonator for input or output. Otherwise, the operation and effect thereof are the same as in the embodiment shown in FIGS. 40 and 41.

Figure 43:
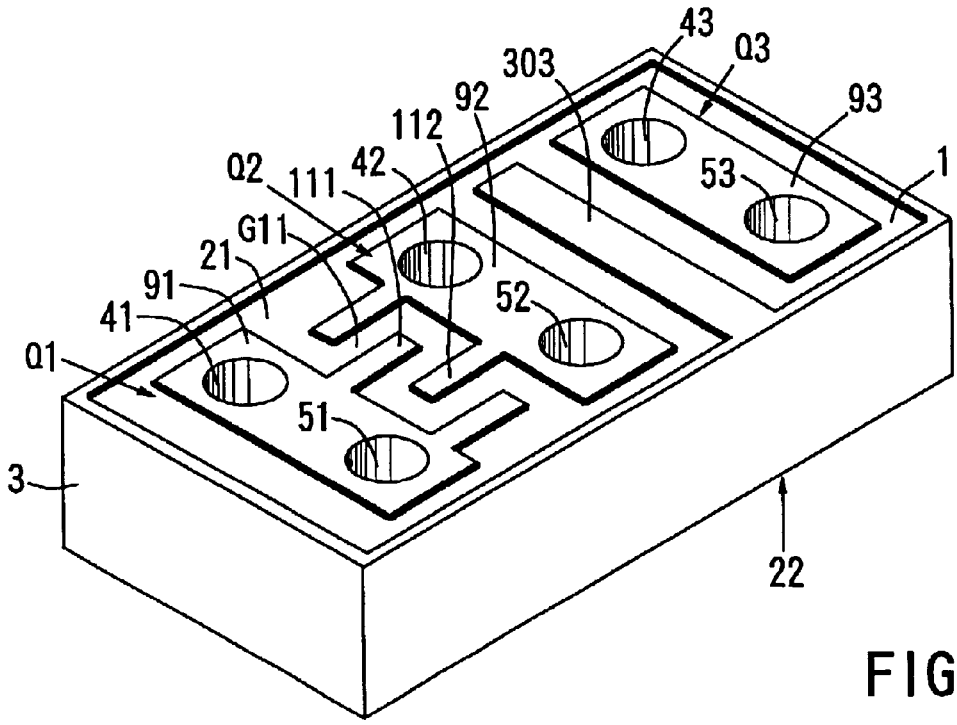
FIG. 43 is a perspective view illustrating yet another embodiment of the dielectric filter in accordance with the present invention.

FIG. 43 is a perspective view illustrating still another embodiment of the dielectric filter in accordance with the present invention. In this embodiment, a conductor film 303 is provided between resonator unit Q2 and resonator unit Q3. Conductor film 303 at one end thereof is connected to external conductor film 3. As a result, resonator unit Q2 and resonator unit Q3 are inductively coupled. Resonator unit Q1 and resonator unit Q2 are capacitively coupled via coupling electrode 111 and coupling electrode 112. Therefore, when resonator units Q1 to Q3 are considered as a whole, a structure is obtained which contains capacitive coupling and inductive coupling. The structure shown in FIGS. 41 and 42 can be employed on the bottom surface of dielectric filter, that is, on opposite surface 22 (this structure is not shown).

Figure 44:
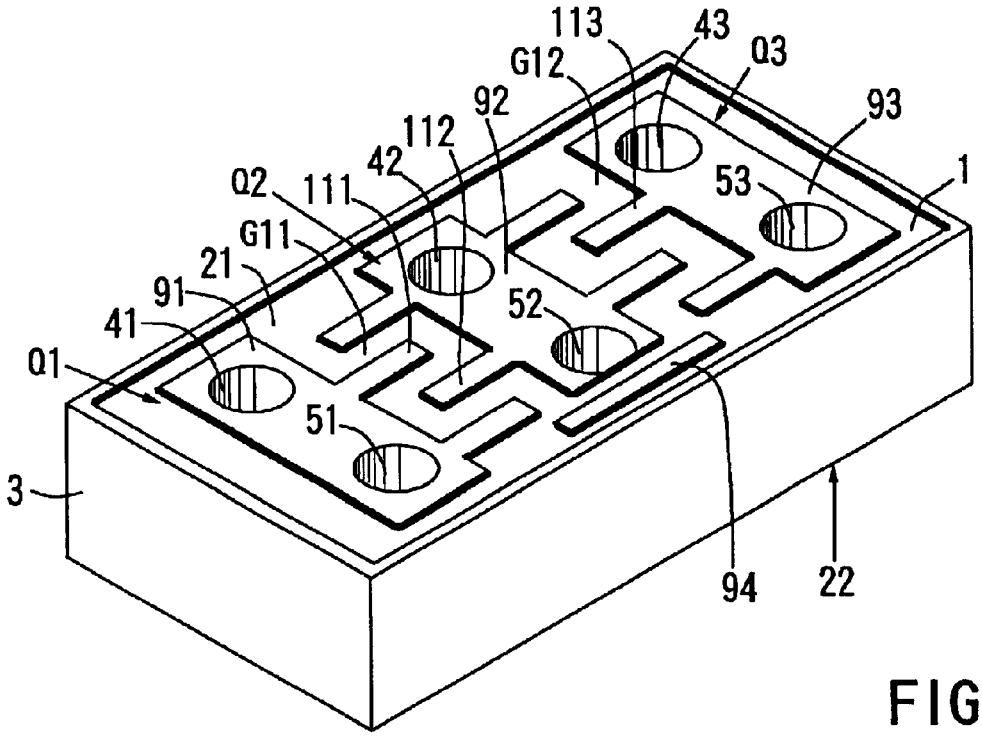
FIG. 44 is a perspective view illustrating yet another embodiment of the dielectric filter in accordance with the present invention.

FIG. 44 is a perspective view illustrating still another embodiment of the dielectric filter in accordance with the present invention. In this embodiment, a conductive film 94 extending in the direction of resonator units Q1 to Q3 is provided on end surface 21 at the side of resonator unit Q2. With such structure, an additional transmission zero can be achieved and a contribution can be made to the improvement of filter characteristics. The structure shown in FIGS. 41 and 42 can be employed on opposite surface 22 of the dielectric filter.

Figure 45:
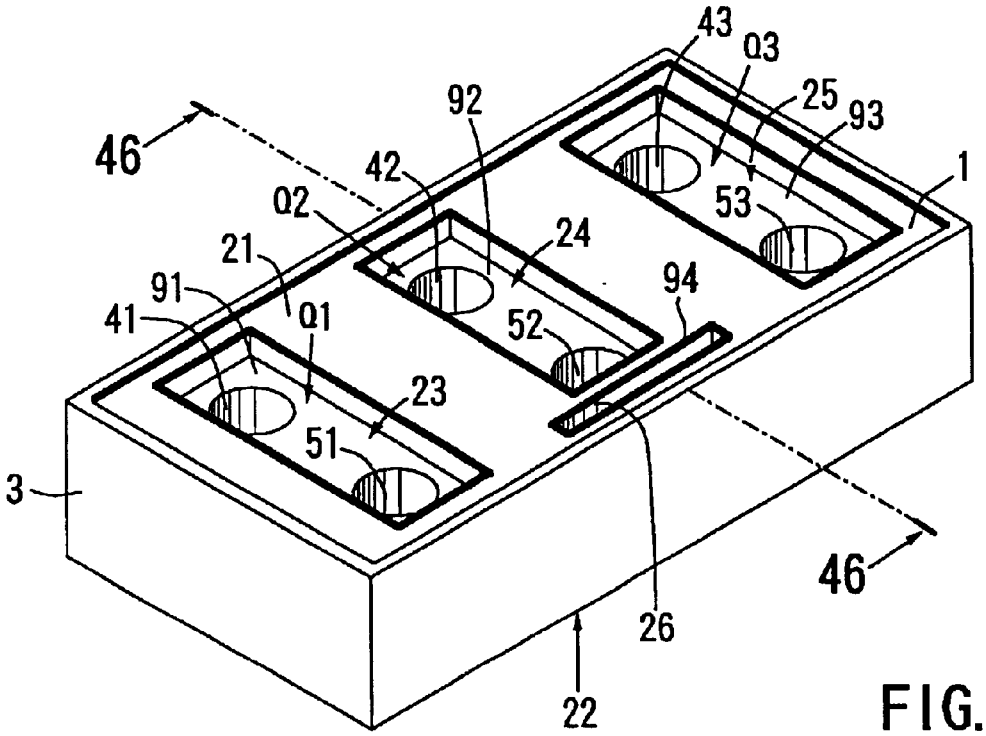
FIG. 45 is a perspective view illustrating yet another embodiment of the dielectric filter in accordance with the present invention.
Figure 46:
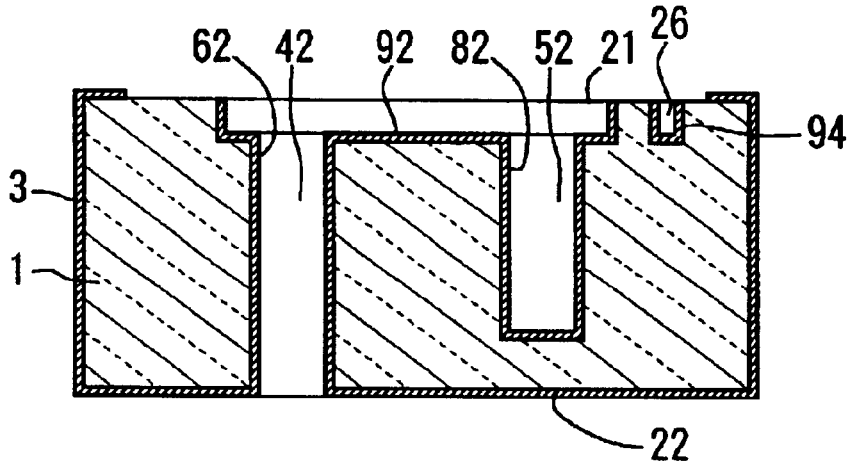
FIG. 46 is a cross-sectional view along line 46—46 in FIG. 45.

FIG. 45 is a perspective view illustrating yet another embodiment of the dielectric filter in accordance with the present invention. FIG. 46 is a cross-sectional view along line 46—46 in FIG. 45. In the embodiment shown in the figures, resonator units Q1 to Q3 have respective step-like recesses 23 to 25. Recesses 23 to 25 are formed in end surface 21 at a certain distance from each other. First hole 41 and second hole 51 are open inside recess 23, first hole 42 and second hole 52 are open inside recess 24, and first hole 43 and second hole 53 are open inside recess 25.

Furthermore, conductive film 91 is formed on the bottom surface and vertical surfaces of recess 23, conductive film 92 is formed on the bottom surface and vertical surfaces of recess 24, and conductive film 93 is formed on the bottom surface and vertical surfaces of recess 25. With such structure, resonator units Q1 to Q3 are capacitively coupled to each other.

Moreover, a recess 26 extending in the direction of resonator units Q1 to Q3 is provided at the side of resonator unit Q2 on end surface 21, and a conductor film 94 is provided on the inner wall surface of recess 26. With such structure, an additional transmission zero can be achieved. Therefore, a contribution can be made to the improvement of filter characteristics. The structure shown in FIGS. 41 and 42 can be employed on opposite surface 22 of the dielectric filter.

Figure 47:
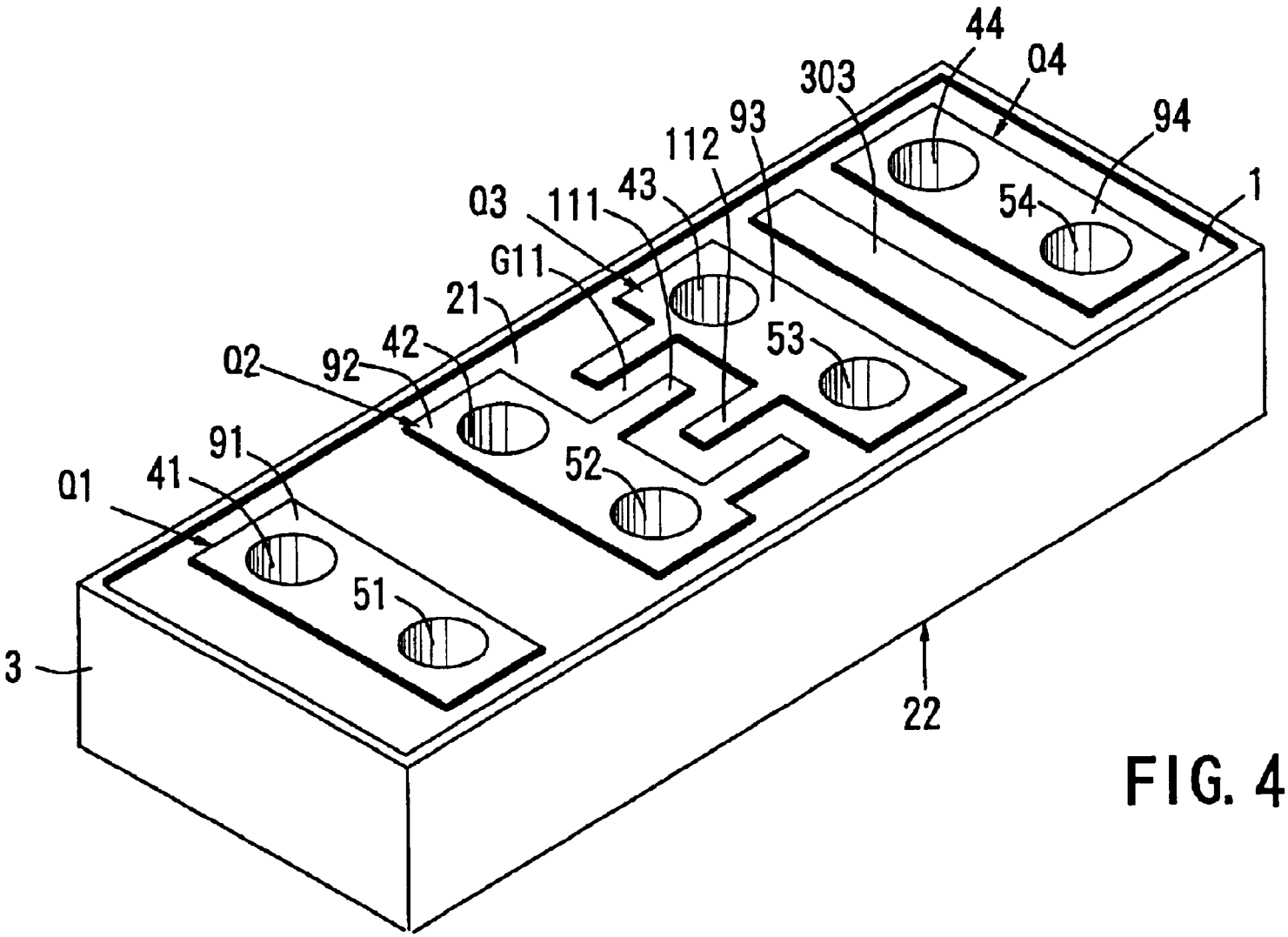
FIG. 47 is a perspective view illustrating yet another embodiment of the dielectric filter in accordance with the present invention.
Figure 48:
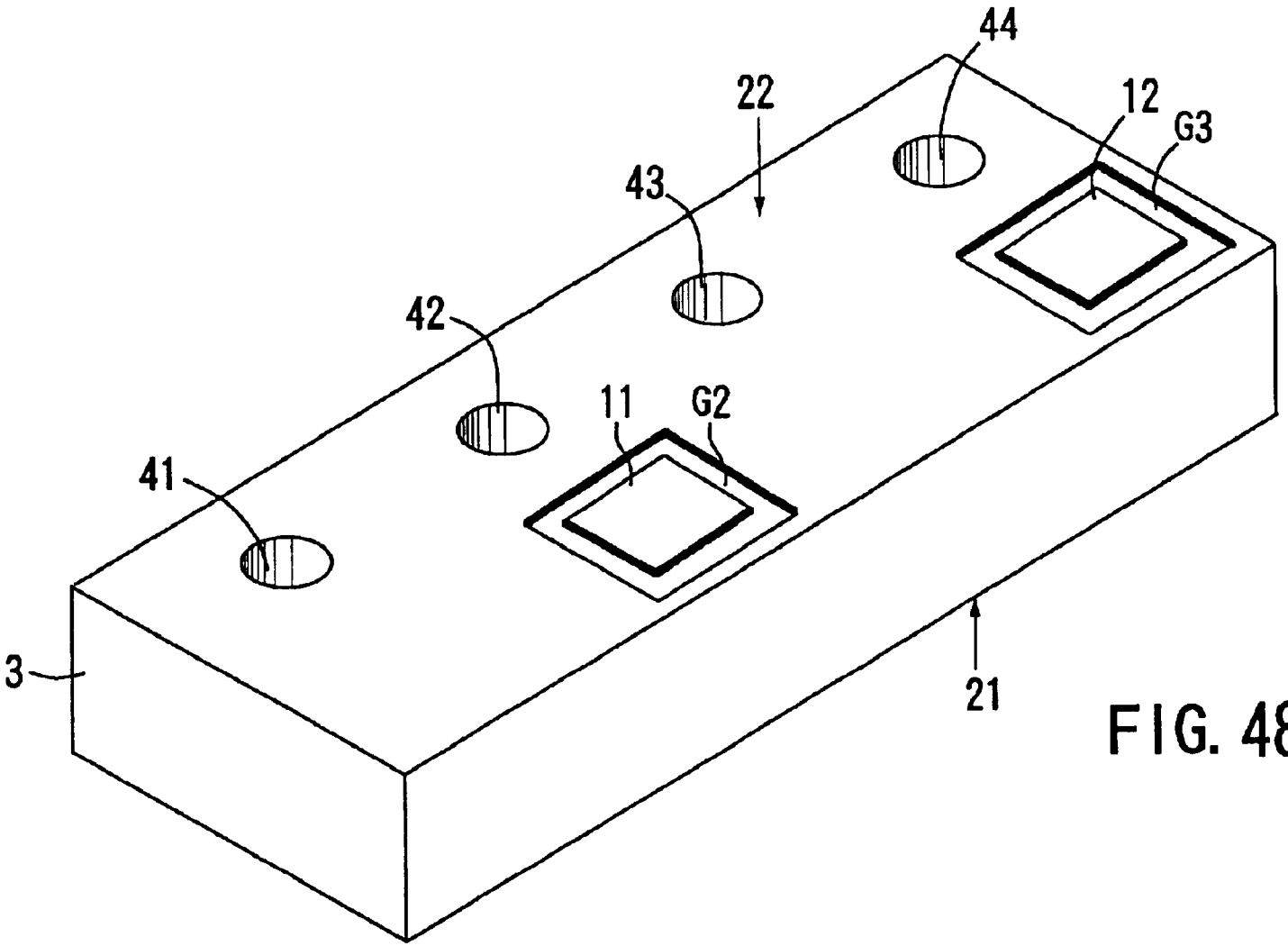
FIG. 48 is a perspective view of the dielectric filter shown in FIG. 47, as viewed from the bottom surface thereof.

FIG. 47 is a perspective view illustrating still another embodiment of the dielectric filter in accordance with the present invention. FIG. 48 is a perspective view of the dielectric filter shown in FIG. 47, as viewed from the bottom surface thereof.

The dielectric filter shown in the figure comprises four resonator units Q1 to Q4. The resonator units Q1 to Q4 have a common dielectric substrate 1 and are integrated via dielectric substrate 1. External conductor film 3 covers a large portion of the outer surface of dielectric substrate 1, except one surface serving as end surface 21.

Resonator unit Q1 comprises first hole 41 and second hole 51. Resonator unit Q2 comprises first hole 42 and second hole 52. Resonator unit Q3 comprises first hole 43 and second hole 53. Resonator unit Q4 comprises first hole 44 and second hole 54. First holes 41 to 44 are through holes, and second holes 51 to 54 are blind holes.

Resonator unit Q2 and resonator unit Q3 are capacitively coupled via coupling electrode 111 and coupling electrode 112, and resonator unit Q3 and resonator unit Q4 are inductively coupled via conductor film 303.

First terminal 11 is disposed in a position corresponding to second hole 52 in surface 22 opposite to end surface 21 in a state in which it is electrically insulated from external conductor film 3 by insulating gap G2.

Second terminal 12 is disposed in a position corresponding to second hole 54 in opposite surface 22 in a state in which it is electrically insulated from external conductor film 3 by insulating gap G3.

In the embodiment shown in FIGS. 47 and 48, a larger number of resonator units Q1 to Q4 are used. Therefore, the frequency selection characteristic is further improved.

The structure of first terminal 11 and second terminal 12 in the dielectric filter with the surface structure shown in FIG. 47 can be implemented in a variety of modifications, in addition to the basic structure shown in FIG. 48. An example thereof is shown in FIGS. 49, 50.

Figure 49:
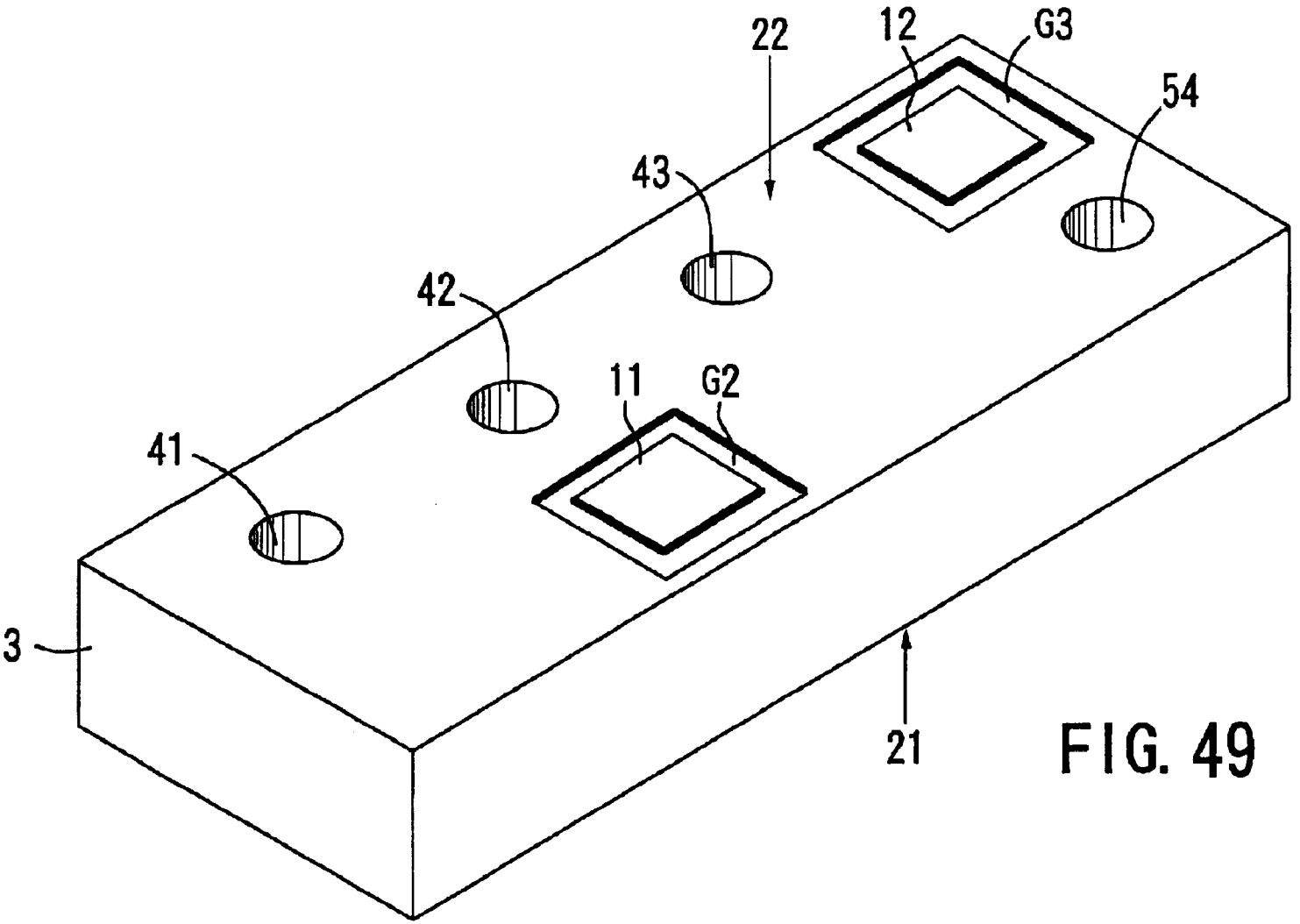
FIG. 49 is a perspective view illustrating yet another embodiment of the dielectric filter in accordance with the present invention.

First, FIG. 49 shows an example of modification in which first hole 44 of the dielectric filter shown in FIG. 47 is a blind hole and second hole 54 shown in FIG. 47 is a through hole. Second terminal 12 is provided in the position on opposite surface 22 corresponding to second hole 44. First holes 41 to 43 are through holes and second holes 51 to 53 (see FIG. 47) are blind holes.

Figure 50:
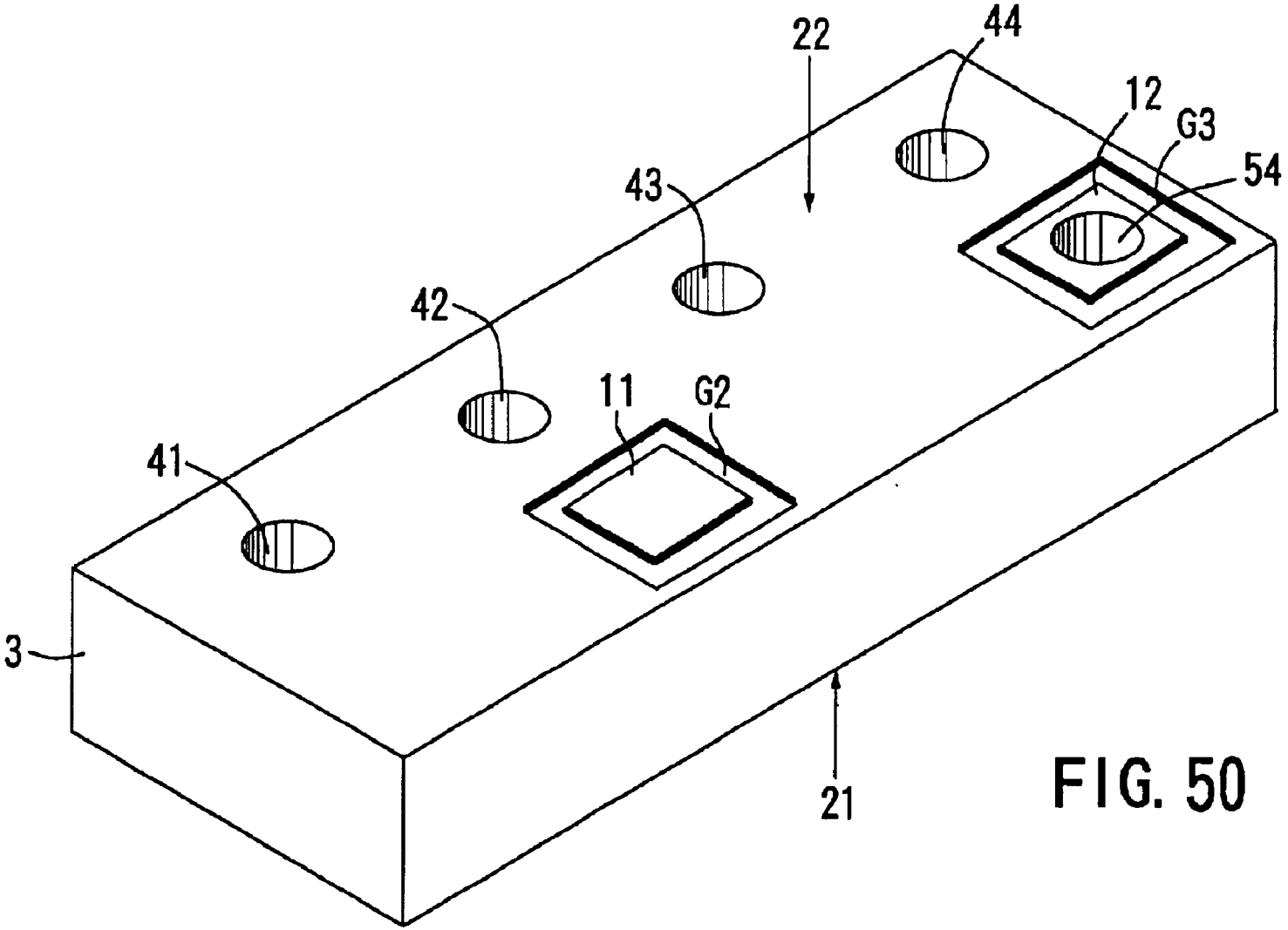
FIG. 50 is a perspective view illustrating yet another embodiment of the dielectric filter in accordance with the present invention.

Then, FIG. 50 illustrates an example in which second hole 54 of the dielectric filter shown in FIG. 47 is a through hole and second terminal 12 is connected to second hole 54. Therefore, resonator unit Q4 operates as a resonator for input or output. Second terminal 12 is electrically insulated from external conductor film 3 by insulating gap G3.

As described above, the dielectric device in accordance with the present invention can be used in a variety of devices including resonators, oscillators, dielectric filters or duplexers. Among them, dielectric filters were described in detail above with reference to FIGS. 1 to 50. On account of space consideration, the explanation relating to dielectric filters will be limited to the description presented above. However, it is obvious that a larger number of resonator units can be provided and that there are a large number of possible combinations of the embodiments described above and illustrated by the figures attached.

A duplexer which is an example of another important application of the dielectric device in accordance with the present invention will be described below.

Figure 51:
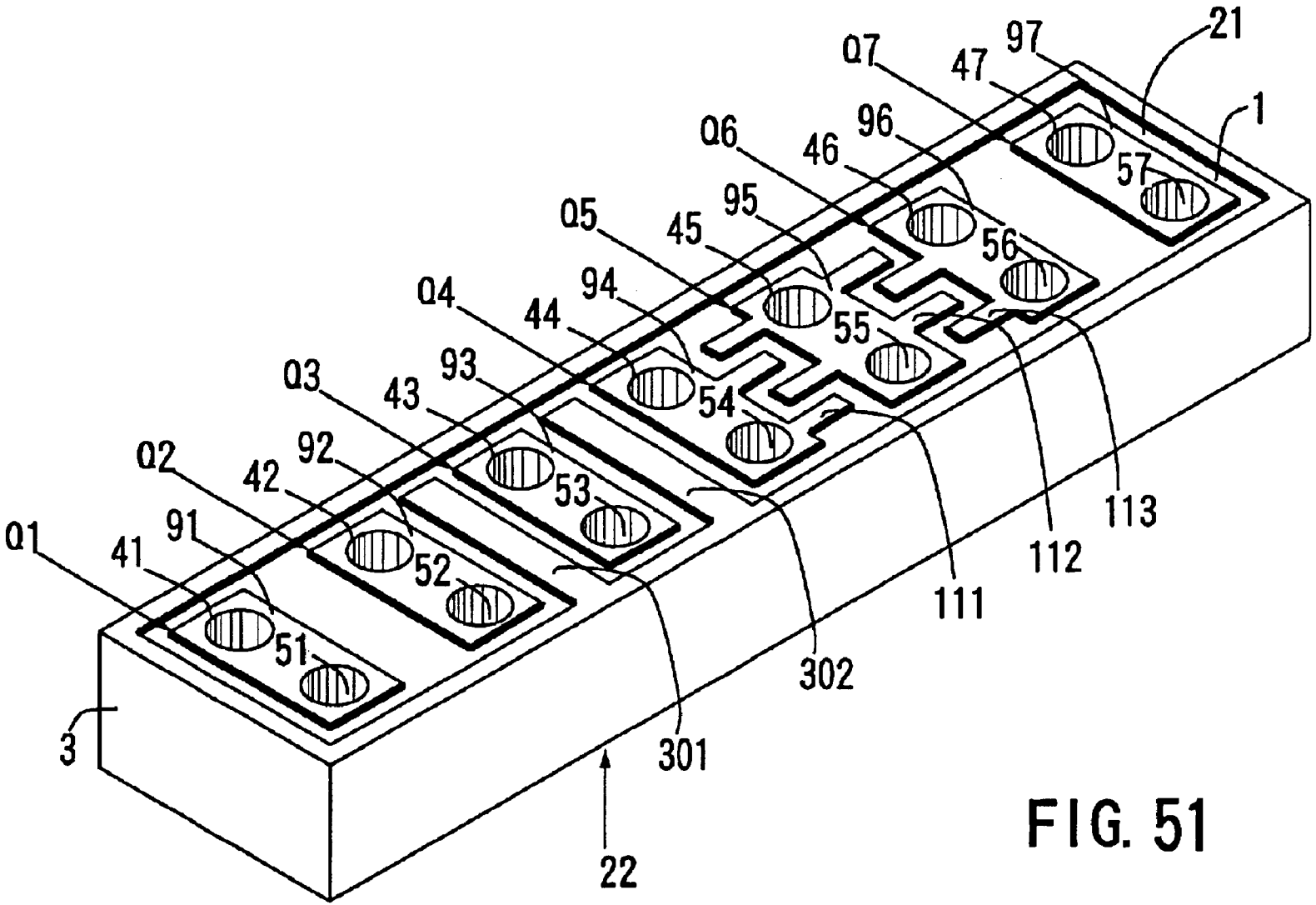
FIG. 51 is a perspective view of the duplexer in accordance with the present invention.
Figure 52:
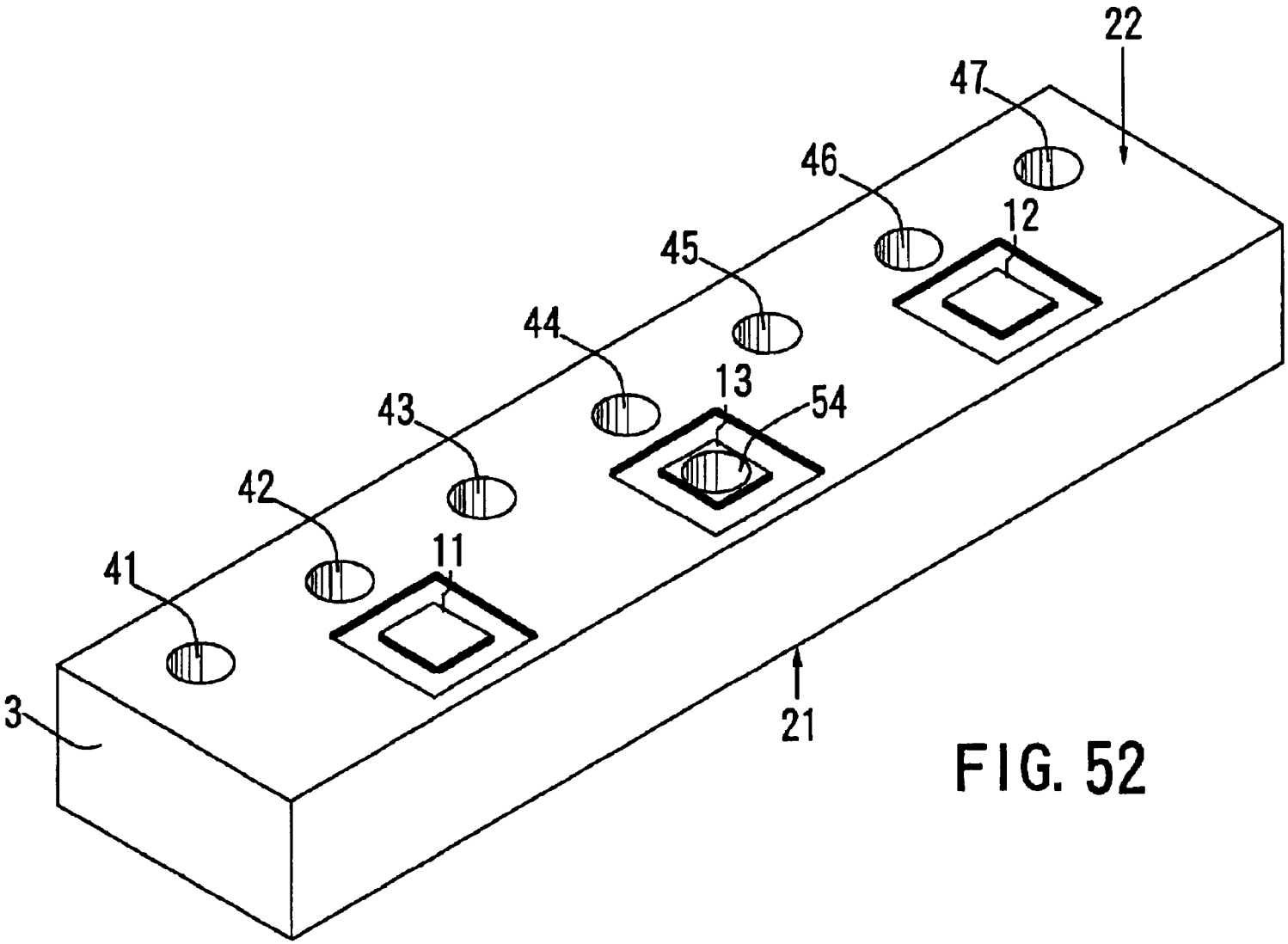
FIG. 52 is a perspective view of the duplexer shown in FIG. 51, as viewed from the bottom surface thereof.

FIG. 51 is a perspective view of the duplexer in accordance with the present invention and FIG. 52 is a perspective view of the duplexer shown in FIG. 51, as viewed from the bottom surface thereof. The duplexer shown in the figures comprises seven resonator units Q1 to Q7. Resonator units Q1 to Q7 use a common dielectric substrate 1 and are integrated via dielectric substrate 1. External conductor film 3 covers a large portion of the outer surface of dielectric substrate 1, except one surface serving as end surface 21.

Among resonator units Q1 to Q7, resonator unit Q1 comprises a combination of first hole 41 and second hole 51, resonator unit Q2 comprises a combination of first hole 42 and second hole 52, and resonator unit Q3 comprises a combination of first hole 43 and second hole 53. Resonator unit Q5 comprises a combination of first hole 45 and second hole 55, resonator unit Q6 comprises a combination of first hole 46 and second hole 56, and resonator unit Q7 comprises a combination of first hole 47 and second hole 57. First holes 41 to 43, 45 to 47 are through holes and second holes 51 to 53, 55 to 57 are blind holes.

First hole 44 and first hole 54 of intermediate resonator unit Q4 are through holes and have no blind holes among them. However, first hole 54 may be a blind hole.

Individual structures of first holes (41 to 47) and second holes (51 to 57) and mutual arrangement thereof are as described in detail with reference to FIGS. 1 to 50.

Since duplexers are used as antenna duplexers, resonator units Q1 to Q7 are divided into two groups, one for a transmitter and one for a receiver. An explanation will be given below based on an example in which resonator units Q1 to Q3 are used for a transmitter and resonator units Q5 to Q7 are used for a receiver.

Since the transmit frequency and receive frequency are different from each other, the resonant characteristics of resonator units Q1 to Q3 is adjusted to the transmit frequency, and the resonant characteristics of resonator units Q5 to Q7 is adjusted to the receive frequency. An antenna is connected to resonator unit Q4.

In resonator units Q1 to Q3 used for a transmitter, conductor films 301, 302 are provided on end surface 21 between resonator unit Q2 and resonator unit Q3 and between resonator unit Q3 and resonator unit Q4, respectively. Therefore, resonator units Q1 to Q3 used for a transmitter are coupled to resonator unit Q4 by inductive coupling.

In resonator units Q5 to Q7 used for a receiver, resonator unit Q4 and resonator unit Q5 are capacitively coupled by coupling electrode 111 and coupling electrode 112, and resonator unit Q5 and resonator unit Q6 are capacitively coupled by coupling electrode 112 and coupling electrode 113.

Among resonator units Q1 to Q3 used for a transmitter, first terminal 11 for a transmitter which is provided on opposite surface 22 is capacitively coupled to second hole 52 contained in resonator unit Q2 via the dielectric portion created by dielectric substrate 1. Such capacitive coupling was described in detail with reference to FIGS. 3 and 4.

Among resonator units Q5 to Q7 used for a receiver, second terminal 12 for a receiver which is provided on opposite surface 22 of dielectric substrate 1 is capacitively coupled to second hole 56 contained in resonator unit Q6 via the dielectric portion created by dielectric substrate 1. Such capacitive coupling was described in detail with reference to FIGS. 3 and 4.

Furthermore, a third terminal 13 for an antenna is connected to through hole 54 of intermediate resonator unit Q4 on opposite surface 22. Therefore, intermediate resonator unit Q4 acts as a resonator connected to an antenna.

First to third terminals 11 to 13 are disposed on opposite surface 22 in a state in which they are electrically insulated from external conductor film 3 by insulating gaps G2 to G4.

With the above-described configuration, first to third terminals 11 to 13 can be surface mounted onto a mounting substrate. Furthermore, the resonant wavelength can be adjusted by setting the depth of second holes 51 to 53, 55 to 57, and distance between respective holes in resonator units Q1 to Q7, and the resonant frequency can be matched with the prescribed value with high accuracy.

Figure 53:
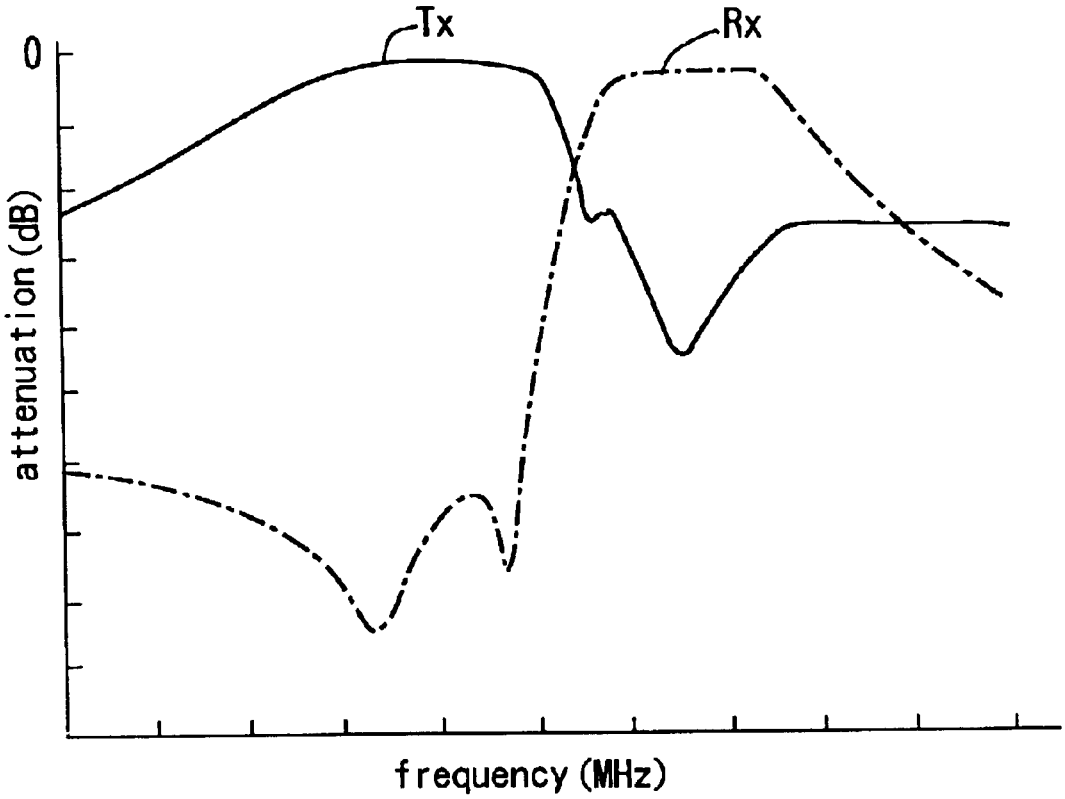
FIG. 53 illustrates a frequency response curve of the duplexer shown in FIGS. 51 and 52.

FIG. 53 illustrates an example of the frequency response curve of the duplexer shown in FIGS. 51 and 52. In this figure, the frequency (MHz) is plotted against the abscissa, and the attenuation (dB) is plotted against the ordinate. The characteristic curve Rx represents a receive frequency characteristic and the characteristic curve Tx represents a transmit frequency characteristic.

As shown in the figure, the receive frequency characteristic Rx and transmit frequency characteristic Tx can be provided with different pass band characteristics.

Figure 54:
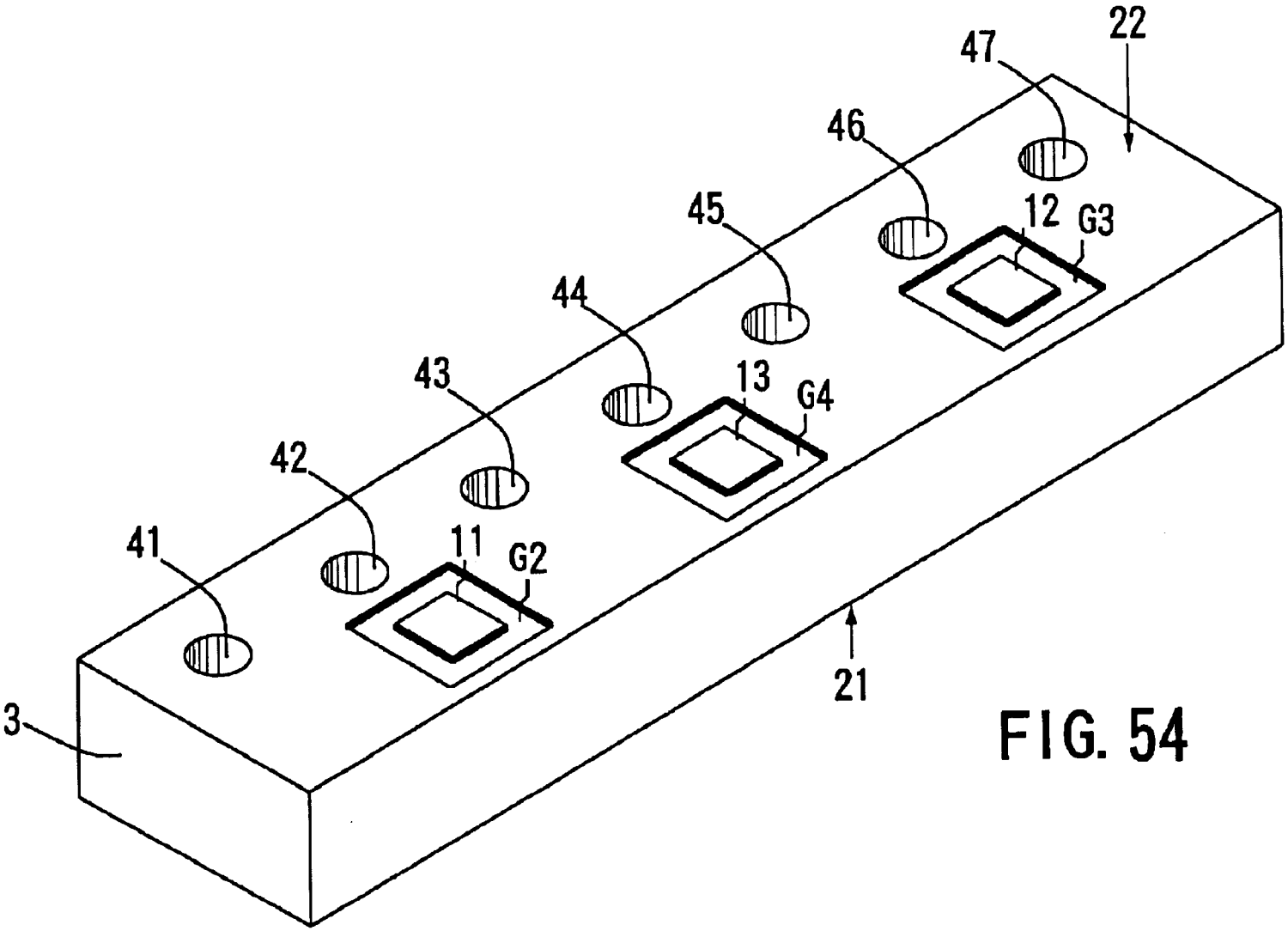
FIG. 54 is a perspective view illustrating yet another embodiment of the duplexer in accordance with the present invention.

FIG. 54 is a perspective view of terminal arrangement on the bottom surface that can be employed in the duplexer having the surface structure shown in FIG. 51. In the embodiment shown in FIG. 54, second hole 54 of intermediate resonator unit Q4 is a blind hole, and third terminal 13 is capacitively coupled to the internal conductor of second hole 54 (see FIG. 51).

Figure 55:
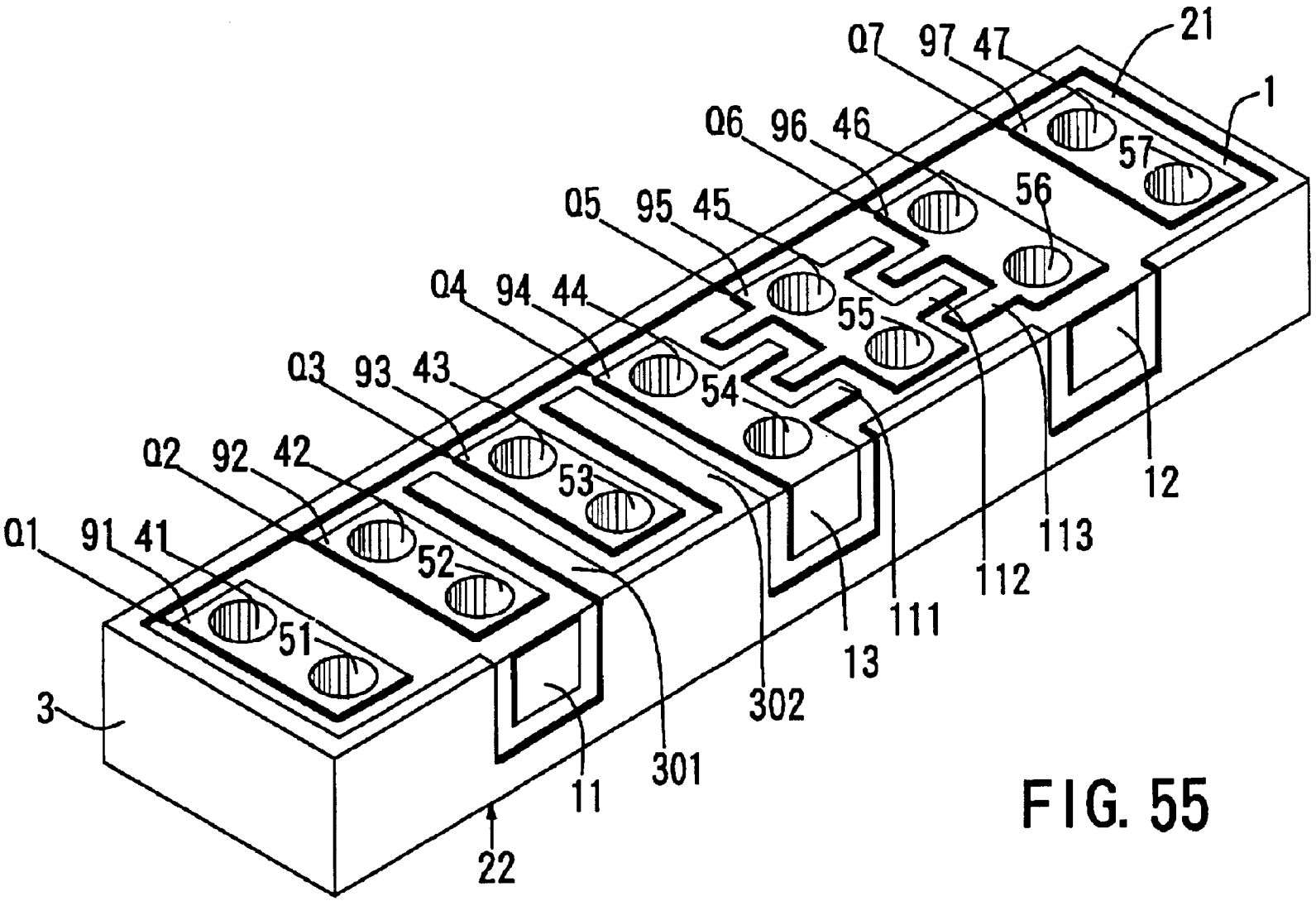
FIG. 55 is a perspective view illustrating yet another embodiment of the duplexer in accordance with the present invention.
Figure 56:
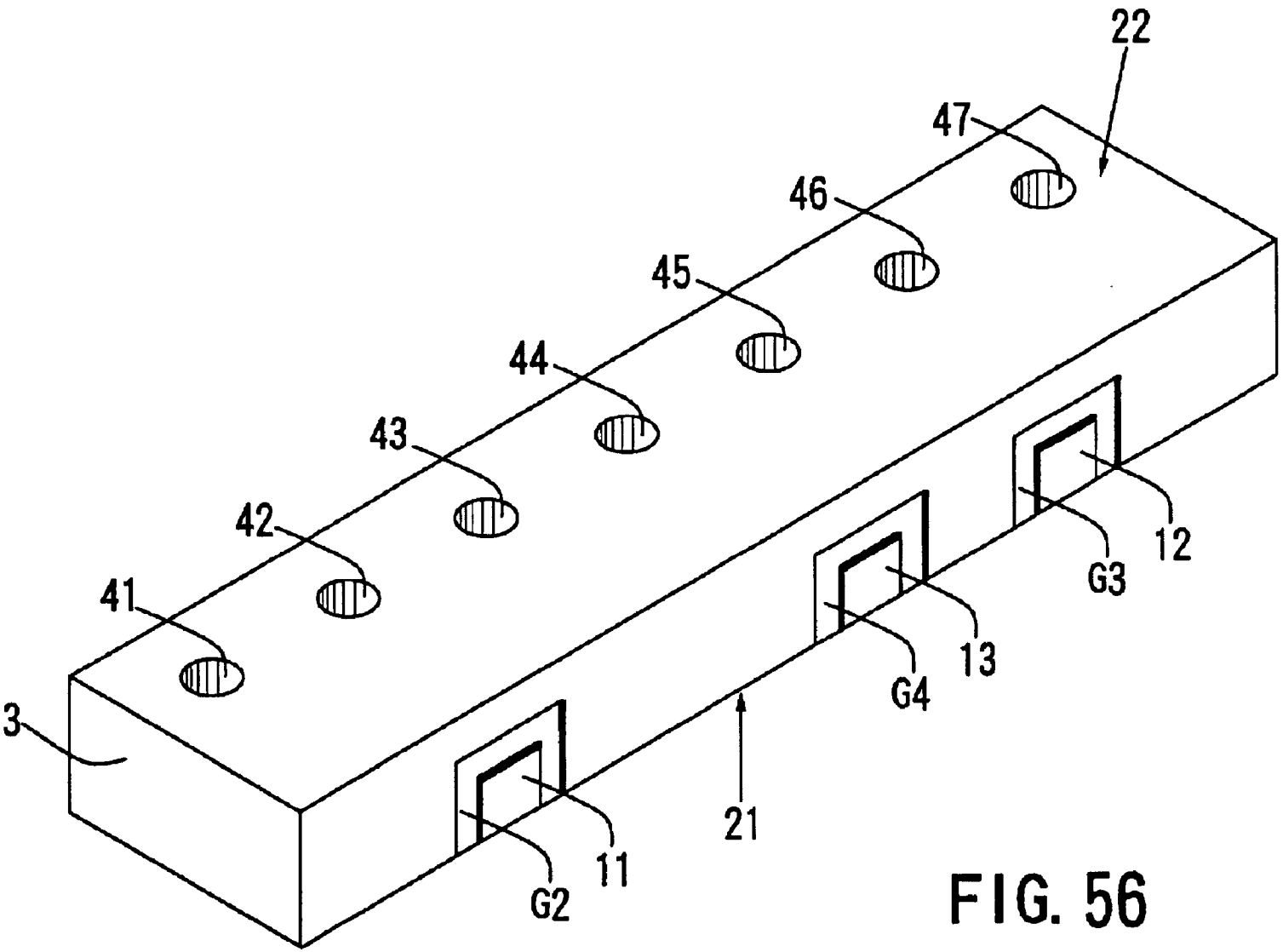
FIG. 56 is a perspective view of the duplexer shown in FIG. 55, as viewed from the bottom surface thereof.

FIG. 55 is a perspective view illustrating another embodiment of the duplexer in accordance with the present invention. FIG. 56 is a perspective view of the duplexer shown in FIG. 55, as viewed from the bottom surface thereof. In the figures, structural components identical to those shown in FIG. 51 are assigned with the same reference symbols.

In this embodiment, first holes 41 to 47 of resonator units Q1 to Q7 are through holes and second holes 51 to 57 are blind holes. Opposite surface 22 of dielectric substrate 1 is covered over the entire surface thereof with external conductor film 3, as shown in FIG. 56.

First and second terminals 11, 12 are capacitively coupled to the internal conductors located inside second holes 52 and 56 which are blind holes via the dielectric portion created by dielectric substrate 1. Third terminal 13 is directly connected to the internal conductor provided in second hole 54 of resonator unit Q4 via conductor film 94. Therefore, resonator unit Q4 is used as a resonator for an antenna.

Figure 57:
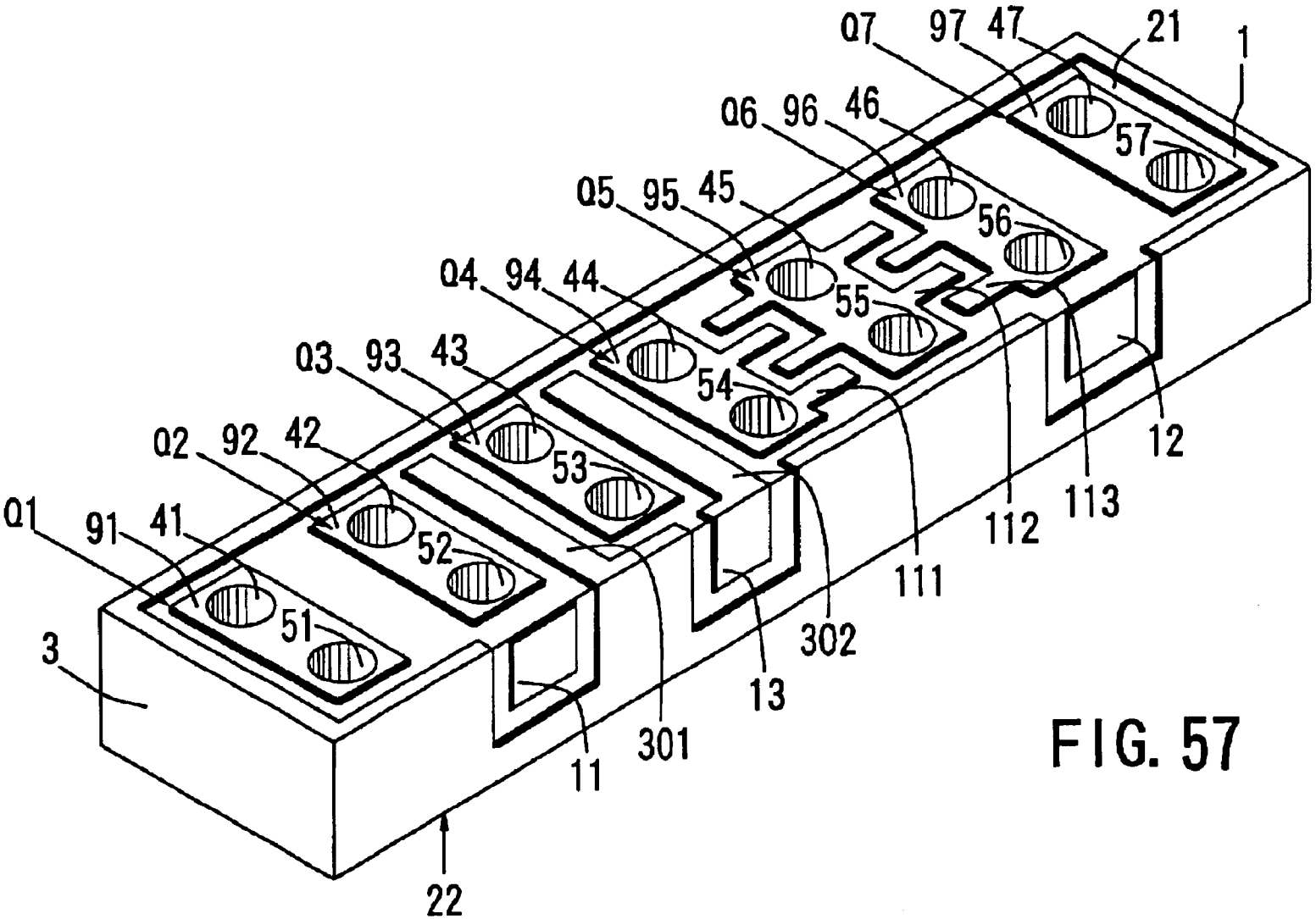
FIG. 57 is a perspective view illustrating yet another embodiment of the duplexer in accordance with the present invention.

FIG. 57 is a perspective view illustrating another embodiment of the duplexer in accordance with the present invention. In this embodiment, first to third terminals 11 to 13 are provided on the side surface of dielectric substrate 1. First and second terminals 11, 12 are capacitively coupled to the internal conductors of second holes 52 and 56, which are blind holes, via the dielectric portion created by dielectric substrate 1. Third terminal 13 serving as an antenna terminal is connected to conductive film 302 provided between resonator unit Q3 and resonator unit Q4. Third terminal 13 serving as an antenna terminal is capacitively coupled to resonator units Q3, Q4.

Figure 58:
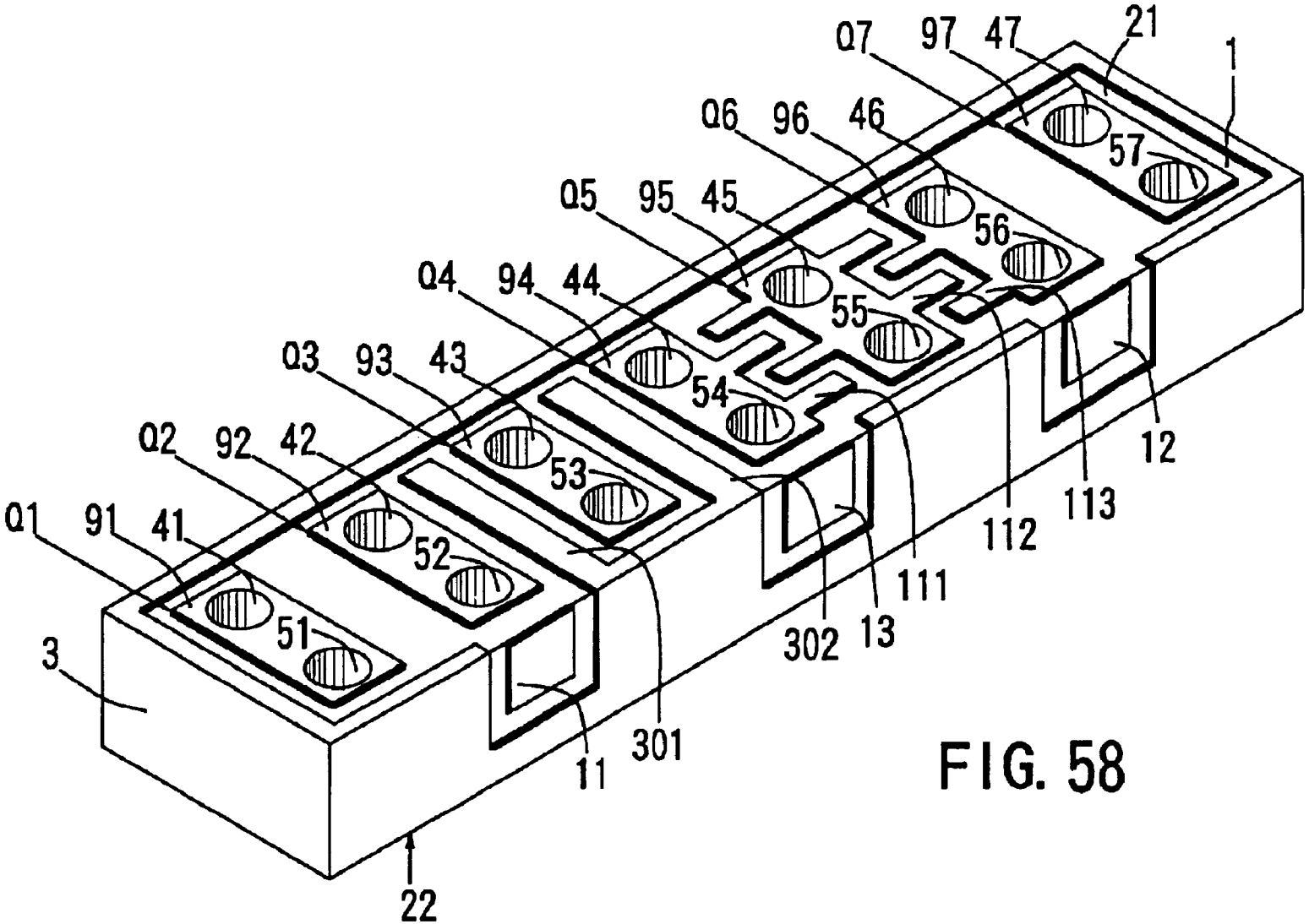
FIG. 58 is a perspective view illustrating yet another embodiment of the duplexer in accordance with the present invention.

FIG. 58 is a perspective view illustrating another embodiment of the duplexer in accordance with the present invention. In this embodiment, first to third terminals 11 to 13 are provided on the side surface of dielectric substrate 1. First to third terminals 11 to 13 are capacitively coupled to the internal conductors of second holes 52, 54, and 56, which are blind holes, via the dielectric portion created by dielectric substrate 1.

Figure 59:
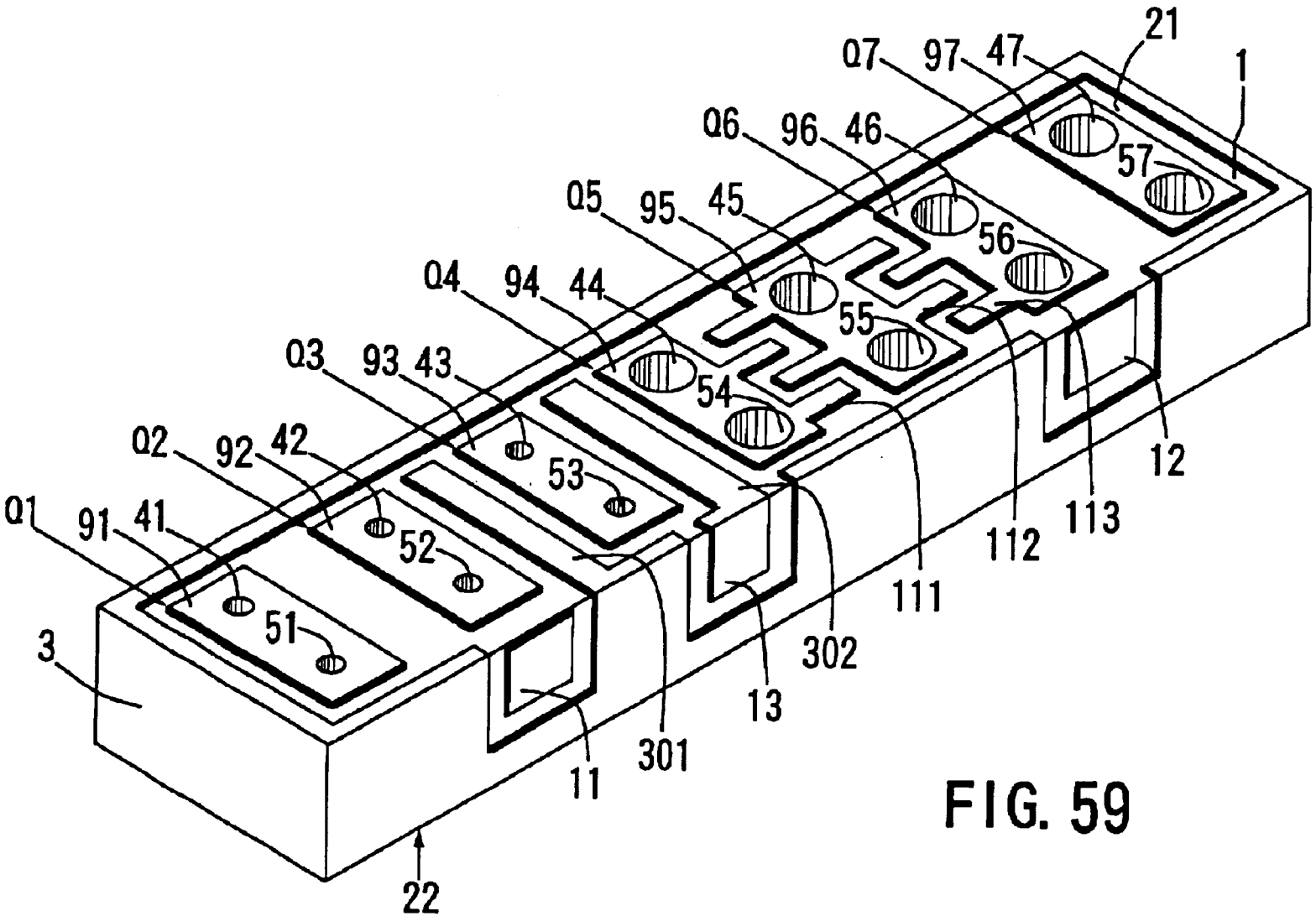
FIG. 59 is a perspective view illustrating yet another embodiment of the duplexer in accordance with the present invention.

FIG. 59 is a perspective view illustrating yet another embodiment of the duplexer in accordance with the present invention. In this embodiment, the diameters of first holes 41 to 43 and second holes 51 to 53 contained in resonator units Q1 to Q3 used for a transmitter, which are seen on end surface 21, are less than the respective diameters of first holes 44 to 47 and second holes 54 to 57 contained in resonator units Q4 to Q7 used for a receiver. With such structure, the distance between the holes can provide for the difference in resonant frequency between the transmit side and receive side and improve the frequency selection characteristic.

Figure 60:
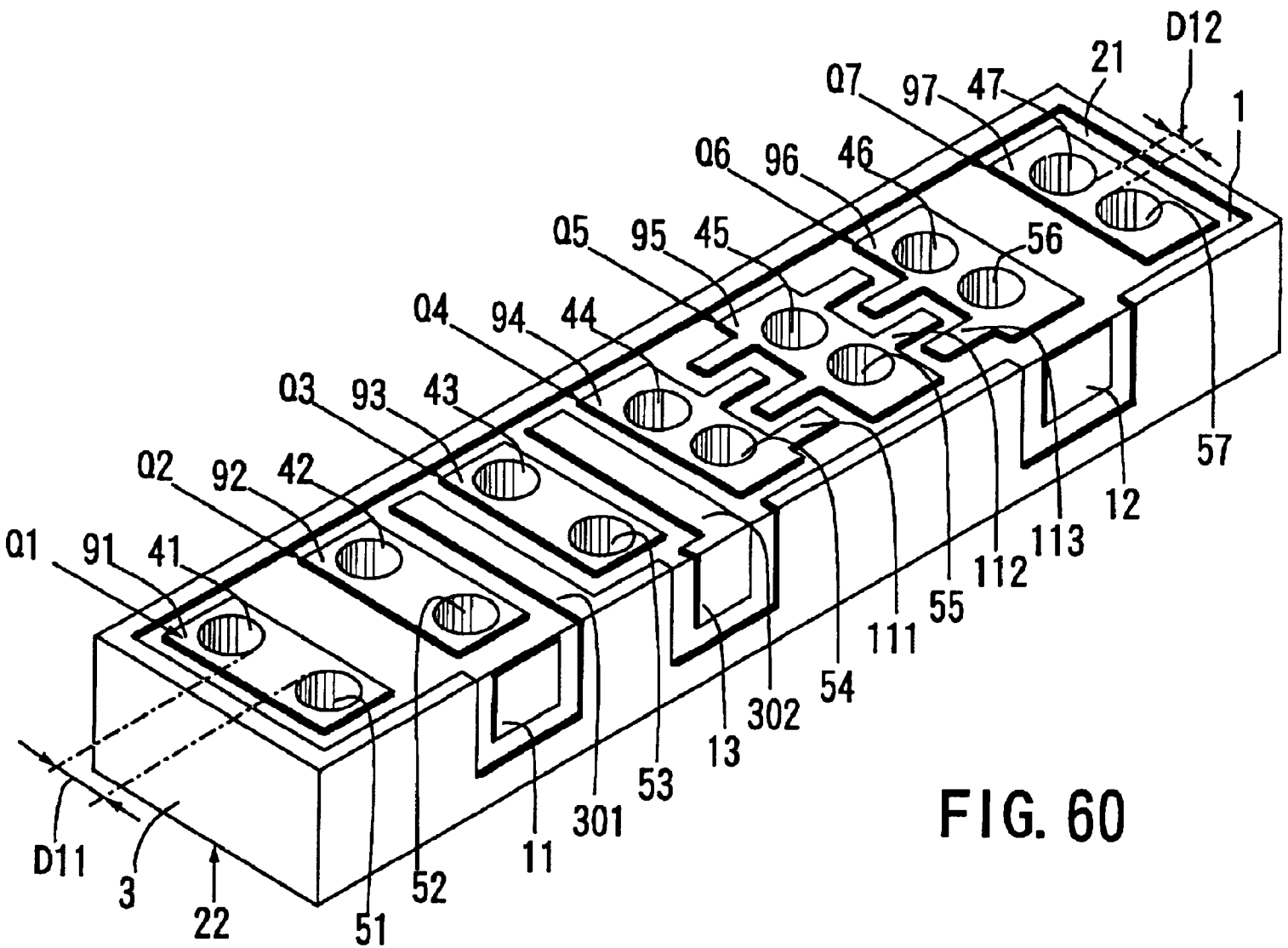
FIG. 60 is a perspective view illustrating yet another embodiment of the duplexer in accordance with the present invention.

FIG. 60 is a perspective view illustrating yet another embodiment of the duplexer in accordance with the present invention. A specific feature of this embodiment is in that the distance D11 between first holes 41 to 43 and second holes 51 to 53 contained in resonator units Q1 to Q3 used for a transmitter is greater than the distance D12 between first holes 44 to 47 and second holes 54 to 57 contained in resonator units Q4 to Q7 used for a receiver.

With such a structure, the difference between distances D11 and D12 can provide for the difference in resonant frequency between the transmit side and receive side and improve the frequency selection characteristic.

It goes without saying that various structures (see FIGS. 1 to 50) illustrated by the examples relating to the dielectric filters can be used in duplexers; such modifications are not shown in the figures.

As described above, the following effects can be obtained with the present invention.

(a) A dielectric device can be provided which allows for miniaturization and thickness reduction.

(b) A dielectric device can be provided which can be surface mounted.

(c) A dielectric device can be provided in which the resonant frequency can be adjusted.

What is claimed is:

1. A dielectric device comprising:

a dielectric substrate including at least one resonator unit;

said dielectric substrate comprising:

an outer surface covered with an external conductor film, excluding at least one end surface, a first hole provided in said dielectric substrate, extending from said at least one end surface to an opposite surface thereto, being open at said at least one end surface and said opposite surface, and having a first internal conductor inside thereof, and a second hole provided in said dielectric substrate at a predetermined distance from said first hole, extending from said at least one end surface toward said opposite surface, being open at said at least one end surface, closed at said opposite surface, and having a second internal conductor inside thereof, said second internal conductor being connected to said first internal conductor at said at least one end surface; and said first hole, said second hole, said first internal conductor, and said second internal conductor forming said at least one resonator unit.

2. The dielectric device according to claim 1, wherein said opposite surface is covered with said external conductor film; and said first internal conductor is connected to said external conductor film present on said opposite surface.

3. The dielectric device according to claim 1, wherein said opposite surface is another end surface.

4. The device according to claim 1, further comprising a terminal, said terminal being provided on said dielectric substrate and capacitively coupled to said at least one resonator unit.

5. The device according to claim 4, wherein said terminal is provided on said outer surface of said dielectric substrate and capacitively coupled to said second internal conductor.

6. The device according to claim 4, wherein said terminal is provided on said outer surface of said dielectric substrate and capacitively coupled to said first internal conductor.

7. The device according to claim 1, wherein a plurality of second holes are provided at respective distances from each other and respective second internal conductors provided in respective second holes are connected at said at least one end surface.

8. The device according to claim 1, wherein a plurality of resonator units are provided and adjacent resonator units are electrically coupled.

9. The device according to claim 8, comprising a first terminal and a second terminal, wherein said first terminal is provided in said dielectric substrate and capacitively coupled to at least one of said plurality of resonator units; and said second terminal is provided in said dielectric substrate and capacitively coupled to at least another one of said plurality of resonator units.

10. The device according to claim 9, wherein said first terminal is provided on said outer surface of said dielectric substrate and capacitively coupled to said first internal conductor.

11. The device according to claim 9, wherein said first terminal is provided on said outer surface of said dielectric substrate and capacitively coupled to said second internal conductor.

12. The device according to claim 9, wherein said second terminal is provided on said outer surface of said dielectric substrate and capacitively coupled to said first internal conductor.

13. The device according to claim 9, wherein said second terminal is provided on said outer surface of said dielectric substrate and capacitively coupled to said second internal conductor.

14. The device according to claim 9, wherein two adjacent resonator units of said plurality of resonator units are capacitively coupled to each other.

15. The device according to claim 9, wherein two adjacent resonator units among said plurality of resonator units are inductively coupled.

16. The device according to claim 1, wherein said at least one resonator unit comprises a step-like recess, said recess being formed in said at least one end surface and comprising, in common, said first hole and said second hole inside thereof.

17. The dielectric device according to claim 1, wherein said first hole has a large-diameter portion and a small-diameter portion, said large-diameter portion being open at said at least one end surface and said small-diameter portion being connected to a lower part of said large-diameter portion.

18. The device according to claim 1, wherein said second bole has a large-diameter portion and a small-diameter portion, said large-diameter portion being open at said at least one end surface and said small-diameter portion being connected to a lower part of said large-diameter portion.

19. The dielectric device according to claim 1, wherein said first hole has a large-diameter portion and a small-diameter portion, said large-diameter portion being open at said opposite surface and said small-diameter portion being connected to an upper part of said large-diameter portion.

20. The dielectric device according to claim 1, which is a dielectric filter.

21. The dielectric device according to claim 1, which is a duplexer.

22. The dielectric device according to claim 21, further comprising three or more resonator units and first, second, and third terminals, said first terminal being electrically coupled to at least one of said resonator units, said second terminal being electrically coupled to at least another one of said resonator units, and said third terminal being electrically coupled to at least one of the remaining resonator units.

* * * * *